US008852033B1

(12) United States Patent
Frost

(10) Patent No.: US 8,852,033 B1
(45) Date of Patent: Oct. 7, 2014

(54) HAND GRIP

(76) Inventor: John Frost, Chatsworth, CA (US)

( * ) Notice: Subject to any disclaimer, the term of this patent is extended or adjusted under 35 U.S.C. 154(b) by 352 days.

(21) Appl. No.: 13/374,740

(22) Filed: Jan. 9, 2012

(51) Int. Cl.
*A63B 69/00* (2006.01)

(52) U.S. Cl.
USPC ..... 473/458; 473/206; 2/20

(58) Field of Classification Search
USPC ..... 473/458, 206; 2/20
See application file for complete search history.

(56) References Cited

U.S. PATENT DOCUMENTS

| | | | | | |
|---|---|---|---|---|---|
| 1,607,022 | A * | 11/1926 | Swinburne | 119/14.22 |
| 1,690,312 | A * | 11/1928 | Rosan | 473/206 |
| 4,461,043 | A * | 7/1984 | Lomedico | 2/21 |
| 4,981,297 | A * | 1/1991 | Foster | 473/206 |
| 5,069,454 | A * | 12/1991 | Frost | 473/206 |
| 5,180,165 | A * | 1/1993 | Frost | 473/206 |
| 5,322,286 | A * | 6/1994 | Frost | 473/568 |
| 5,377,984 | A * | 1/1995 | Ciccia | 473/206 |
| 5,479,660 | A * | 1/1996 | Najac | 2/20 |
| 5,588,651 | A * | 12/1996 | Frost | 473/206 |
| 5,806,091 | A * | 9/1998 | McHugh | 2/20 |
| 5,954,591 | A * | 9/1999 | Liberatore | 473/206 |
| 6,152,831 | A * | 11/2000 | Arcenas | 473/206 |
| 6,540,621 | B1 * | 4/2003 | Robinson | 473/201 |
| 6,599,200 | B1 * | 7/2003 | Kallassy | 473/204 |
| 6,757,915 | B2 * | 7/2004 | Sidlo | 2/16 |
| 7,048,637 | B2 * | 5/2006 | McDonald | 473/203 |
| 7,179,180 | B1 * | 2/2007 | Frost | 473/458 |
| 7,537,525 | B2 * | 5/2009 | Wang | 473/206 |
| 7,963,864 | B2 * | 6/2011 | Frost | 473/458 |
| 8,266,719 | B2 * | 9/2012 | Duby | 2/161.1 |
| 2005/0124428 | A1 * | 6/2005 | Kelly | 473/201 |
| 2009/0170621 | A1 * | 7/2009 | Evans | 473/206 |
| 2013/0190097 | A1 * | 7/2013 | Shealy et al. | 473/206 |

* cited by examiner

*Primary Examiner* — Gene Kim
*Assistant Examiner* — M Chambers
(74) *Attorney, Agent, or Firm* — Sandy Lipkin

(57) ABSTRACT

A flexible, semi-rigid hand accessory designed to harness power from relatively strong, tough areas of the hand and disperse stress away from weak, sensitive areas by means of anchors pressing into tough fleshy areas with connecting structure capable of bracing and leveraging a handle away from sensitive bony areas, relocating fleshy areas into supporting and insulating positions, preventing bone bruises, enhancing finger gripping and widening the effective grip of the hand for greater control while augmenting the hand's range of motion especially in swinging a baseball bat.

31 Claims, 8 Drawing Sheets

600D

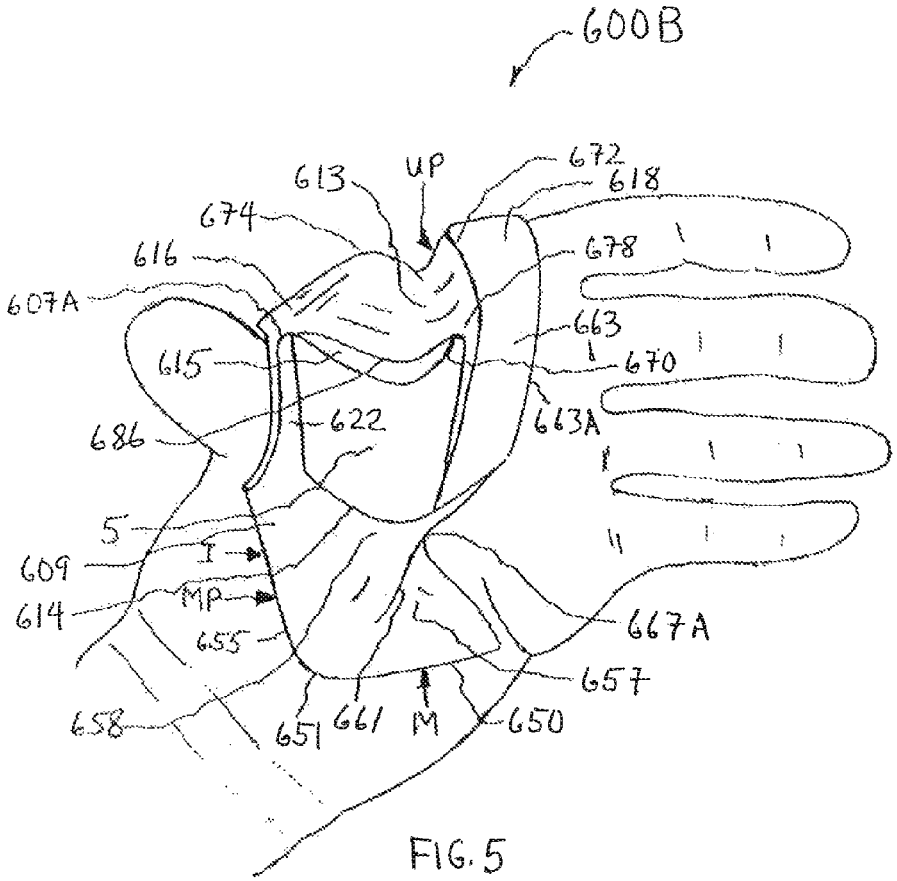
FIG. 5
FIG. 6
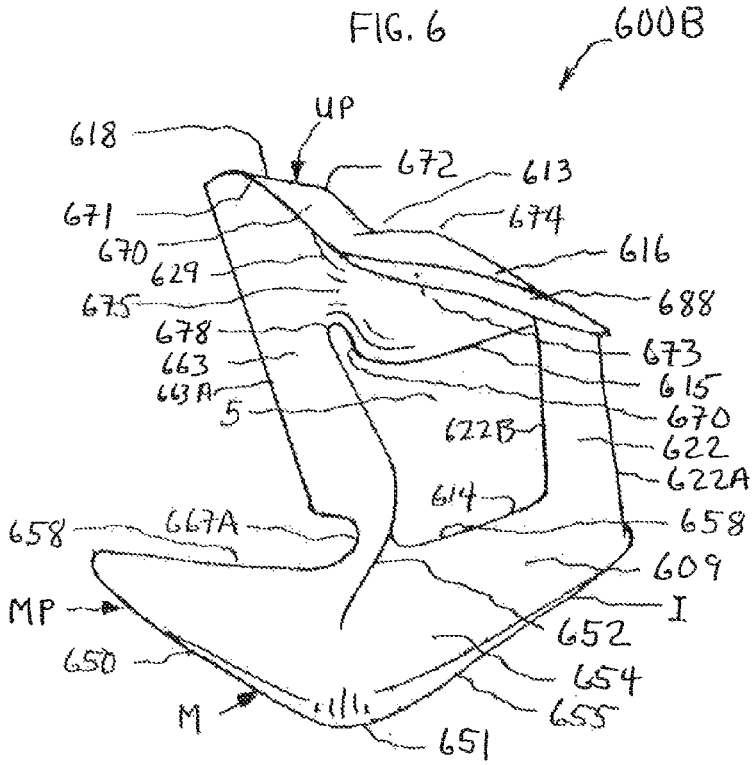

HAND GRIP

BACKGROUND OF THE INVENTION

1. Field of the Invention

The field of this invention relates generally to hand accessories used in gripping the handle of an implement such as a baseball bat with the aim of protecting the user's hands and enhancing the gripping motion of the user's hands thereby improving power transmission and control of the handle of the implement thus improving the quality of hitting when swinging a baseball bat.

2. Description of the Prior Art

Hand accessory 500 of previous U.S. Pat. No. 7,963,864 B2, filed Dec. 12, 2008 by the present inventor, relied greatly on lower hand grip 510 (in combination with upper hand grip 520) to achieve the desired benefits of protection and stress reduction to the hand, aiding the fingers in gripping and enhancing control when swinging a base ball bat or gripping other similar handles. A major goal of previous patents by the present inventor has been to reduce stress to upper, weaker areas of the hand by contacting the handle at a lower area and receiving greater inertial handle force in lower areas of the hand, which was and is the benefit of lower hand grip 510. Being satisfied with lower hand grip 510, the current inventor's aim was to improve areas of hand accessory 500 upwards of lower hand grip 510, thus the goal of the current application, hand grip 600, is improvement of upper hand grip 520 such that it could stand alone, affording similar benefits provided in hand accessory 500 but without the assistance of lower hand grip 510.

Current hand grip 600 has succeeded in improving the cushioning reception of inertial handle force not only by a lower reception area than upper hand grip 520 but also by a better means of dispersing force to the upper hand wherein sensitive knuckles and tendons must be avoided, this accomplished by a far more external, three dimensional structure than upper hand grip 520.

Thus, current hand grip 600 may be used independently, or may be used in combination with lower hand grip 510 of hand accessory 500, being separate as in embodiment 500D or joined as in all previous embodiments.

For a more lengthy explanation of the prior art, including gripping analysis and difficulties encountered one may refer to U.S. Pat. No. 7,963,864 B2, or any of the inventor's seven issued patents on hand accessories, each having detailed comparisons with the prior patent.

The following will summarize the general elements and concepts found in the inventor's prior issued patents which have led to current hand grip 600. The inventor's second U.S. Pat. No. 5,180,165 showed a plug type structure that filled in fleshy web areas which succeeded in positioning the handle out in the fingers and provided some protection to the thumb bone, however the comfort level was not satisfactory due to restriction of the hand's gripping motion which was not understood at the time. The structure of top portion 100 and downward depending portion 102 has been retained and modified in succeeding patents, now called upper hand plane UP but previously referred to as upper web relocation press 417 (beginning in U.S. Pat. No. 7,431,671 B1), whereby thumb bone protection was accomplished by means of a moving/flexing structure and fleshy relocation with elimination of rigid/bulky structure (more later on pivotal U.S. Pat. No. 7,431,671). Third patent, U.S. Pat. No. 5,322,286 increased the cushioning of previous top portion 100 with horizontal portion 52 and groove 48 being similar in purpose to trough 613 in current hand grip 600, however groove 48 was not accompanied by structure necessary to space handle 48 enough distance from thumb joint 34 (thumb knuckle) as does current thumb/handle spacer 616 and thumb base lever 614. Fourth patent, U.S. Pat. No. 5,588,651 was the first somewhat successful attempt at flexibility and harnessing power from the lower hand and wrist (protuberance 94), and somewhat successful attempt at leveraging and spacing the handle a further distance from the thumb, with flange 113, also allowing greater thumb movement, but still not accounting for the entire inner hand and wrist moving forward and downward relative to the outer hand (holding the handle) moving rearward. The discomfort of receiving stress in the upper hand (thumb/web area) from inertial handle 48 led to fifth U.S. Pat. No. 7,179,180 B1, wherein structure was designed to dissipate stress into the lower hand (tough ball/lower lifeline/wrist area). Pivotal embodiment 203 (FIGS. 13-19 of fifth patent) became the basis for all lower hand structure in succeeding embodiments up to lower hand grip 510 of previous U.S. Pat. No. 7,963,854. Sixth U.S. Pat. No. 7,431,671 was a true breakthrough having an open web area (a space) providing a certain type of flexibility which allowed improved phase two motion while still providing protection for thumb bone and second joint (knuckle) 34, a concept (space in the web and mid palm area surrounded by structure) that has continued in all succeeding upper hand structures by this inventor. Embodiment 400, FIGS. 27, 28, 34 & 35 depicts a moving structure and fleshy relocation protecting the thumb while the space (un-numbered, surrounded by 414, 418 & 454) eliminates bulkiness, pinching, impinging of the joints and tendons, and upper hand stress from the recoiling handle as the hand closes, however complete unrestricted range of motion (phase two through phase four) was still not achieved. The open web area, or "disconnect" area, continued in seventh U.S. Pat. No. 7,963,864 B2 (spaces 5, 2 and 1A in FIGS. 3, 5, 9 & 11) and current hand grip 600, having a larger space 5.

Hand grip 600 improves over upper hand grip 520 of disconnected embodiment 500D of U.S. Pat. No. 7,963,864 B2 and also the upper hand grips 520 of connected embodiments 500A,B &C, by more successfully receiving inertial handle force in a lower portion of hand grip 600 and by leveraging handle 48 further outward in the fingers, thus disbursing stress to lower, stronger areas of the hand, while avoiding stress to the thumb bone, upper web, index finger knuckle and tendons and thumb muscles, increasing gripping comfort and protection in hand grip 600.

Because the handle is gripped in the outer hand (finger/knuckle area) and much of the anchoring of hand grip 600 is at the inner hand including lower thumb base 30, and because thumb base 30 (along lifeline 36) angles toward the wrist (away from the outer hand), the lower the reception area the greater the distance in bridging between inner hand anchors and the outer reception area. (The need for "bridging" the hand with thin material rather than blocking the handle with thick padding has been explained in previous of the inventor's patents, thick padding restricting the normal gripping motion reducing power.)

One apparent new component of the lower reception (handle contact) area is a semi-planer externally extending structure, mid hand plane MP, composed of mid hand cushion M and inner hand structure I. New structure within mid hand plane MP is primary handle contact 660 of mid hand cushion M supported cross-wise and truss-like by thumb base lever 614 of a planer, externally located inner hand structure I (FIGS. 1,9&10. Primary handle contact 660 is located within and below the area of the hand's ring finger hollow 8 (FIGS. 11&12), an area identified by the current inventor in earlier patents as a potential anchoring and reception area due to its toughness, depth (concave shape) and because it remains almost stationary relative to the hand's movement through phases 2,3 and 4. Implementing the area of ring finger hollow 8 as an anchoring and reception area is now more successful than in all previous attempts (several attempts prior to hand accessory 500) due to the more external position of mid hand plane MP allowing the inner hand (inward of transverse crease 11) to move forward, downward and upward in closing without dislodging structure (such as lifeline anchor 652 pressing within lower web 32, lifeline 36 and thumb base 30) providing cushion while avoiding collapse of primary handle contact 660 and without impinging upon surrounding sensitive bones and tendons or impeding the full gripping range of motion (phase one through phase four). Note: Locations of structure relative to the hand are somewhat different in the various embodiments, being higher in the hand in earliest embodiment 600C and moving lower in the hand in more current embodiments, such as 600D. For example, primary handle contact 660, an area integral with junction 667, outer/mid connection 667A, portions of bridging perimeter 658 and handle contact ridge 661 in earlier embodiments, moves with mid hand cushion M to a lower area of the hand formerly occupied by bridge 540 of lower hand grip 510, and also be partially separated by space 2 from the above mentioned formerly integral structure (FIGS. 13-15). Thus current hand grip 600 is less dependent, or completely independent of lower hand grip 510 of previous U.S. Pat. No. 7,963,864 B2, and lower hand grip 510 may be reduced in size or eliminated.

Another apparent new component is a large, externally extending outer web cushion 618 being a component of an upper hand bridging perimeter 686 extending forwardly and externally of the hand's web which is a handle contact area of upper hand plane UP.

[NOTE: Single and two digit numbers identify hand areas (and spaces), three digit numbers identify the patented structure. Letters identify larger areas having two or more numbered structures. Although new structures have new names, the majority of the specification and claims use the same names and last two digits as similar structure of previous 500 embodiment, for instance thumb lever 514 becomes thumb base lever 614. However, some of those names seemed to limit descriptive capability where structure has been repositioned and re-angled to have a somewhat different purpose, so some new terminology has been introduced to clarify.]

In comparing with previous upper hand grip 520, thumb joint anchor 622 (FIG. 1) now is positioned more external of the hand, connecting to the inner side of deflector 609 (spaced connection 607) at almost a right angle tilting deflector 609 forwardly so that the upper edge of deflector 609 (thumb base lever 614) is now actually an outer/external edge, being angled toward the handle almost perpendicular and right angled to handle 48, deflector 609 still being integral with thumb harness 654 known as inner hand structure I which is the more planer portion of mid hand plane MP (mid hand cushion M being the more arcing/flexing portion), a bending within mid hand cushion M and at offset connection 668 (apparent and numbered only in embodiment 600C) allowing a lower portion of inner hand structure I to contact the hand's thumb base and lifeline area bracing primary handle contact 660 and other outer receiving areas externally against inertial handle 48, with an upper portion of deflector 609 external of the palm and below thumb second joint 34. Thumb base lever 614 (now the external/outer edge of deflector 609), thus located considerably lower and leveraging against handle 48 right angled in a lower, more powerful area than previous thumb lever 514, thumb base lever 614 (within bridging perimeter 658) now extending to a strong receiving area, such as primary handle contact 660 at junction 667 or outer/mid connection 667A (see embodiments 600C & 600B) at roughly perpendicular. Note: Thumb base lever 614 is an inner portion of bridging perimeter 658 (FIGS. 5, 6 & 14) which extends as a lever outward to mid hand cushion M including such as primary handle contact 660 and handle contact ridge 661. Because embodiment 600A and especially 600D extend further outward and lower in the hand than 600C & 600B, the above described right angled leveraging is only apparent in an upper/inner area of 600A & D. Primary handle contact 660 extends upwardly as outer transverse anchor 663, also an important receiving area. Outer transverse anchor 663 is similar in appearance to previous lifeline anchor 552 but different in location (further outward) and somewhat in purpose. [However embodiment 600B (shown for left hand usage, FIGS. 5&6), having a smaller mid hand plane MP and greatly reduced primary handle contact 660, shows outer transverse anchor 663 angling inwardly of the hand's transverse crease becoming a lifeline anchor, and embodiment 600D is a combination of A & D, having outer transverse anchor 663 split in two sections anchoring outwardly and inwardly.] Primary handle contact 660 extends downwardly, then inwardly as ring finger trough anchor 662 being a portion of mid hand perimeter 650 adjacent the area of ring finger trough 18 and tough ball 38 in embodiments 600B & C (the mid hand), the combined structures along with an outer area of bridging perimeter 658 being a major portion of mid-hand cushion M.

Unlike previous embodiments, a large amount of structure is located exterior of the hand's lifeline 36 during phase one grip (not pressing in), and some areas such as an upper portion of deflector 609 remain external throughout the grip. Current lifeline anchor 652 (FIGS. 2, 7 & 8) which, during phase one, is held externally of the hand's lifeline 36 at a tension area which is enhanced by the planer structure and connection of mid hand cushion M and inner hand structure I at offset connection 668 located a distance externally of the hand due in part to the planer extension across the palm (the area of bridging perimeter 658) and angles of attachment between thumb joint anchor 622, deflector 609, and primary handle contact 660 creating an external reception area of handle 48 (or tension area) which creates a spring-like cushion against inertial handle force over sensitive portions of the hand's palm.

Lifeline anchor 652 moves interiorly due to gripping and inertial handle force beginning at phase two pressing into the area of lifeline trough 36A and lower web 32, a similar area as contacted by thumb spread 526 of previous embodiments. The current benefits of lifeline anchor 652 and thumb spread 626 however are greater with the current externality allowing a better anchoring approach, thus deeper anchoring (not being dislodged by the bulging thumb base 30 muscle) and improved thumb spreading (thumb spread 626 within the fleshy web preventing thumb knuckle 34 from bumping hand grip structure), explained in the detail.

The following analysis more fully explains the success of current hand grip 600 in receiving and dispersing inertial handle force to (or accessing power from) the strongest areas of the hand:

Like a lever, the thumb's strongest area is the area that moves the least distance which is the lowest area of thumb base 30 (lifeline trough 36A and thumb third joint 35). Equally important in contributing strength is the arm (wrist) moving directly behind the inner hand in closing, acting as a buttress. In other words, the gripping motion (aside from the fingers) is not so much the thumb moving as it is the whole inner hand moving forwardly supported (buttressed) by the wrist in the area considerably below thumb knuckle 34, there being no direct support to the upper area of thumb base 30 and thumb knuckle 34. Now, with the more external location of mid hand plane MP and bracing from a more external upper hand plane UP, deflector 609 is supported externally of the bulging mid to upper area of thumb base 30 allowing more dispersion of force to carry through lifeline anchor 652, thumb harness 654, thumb harness perimeter 655 and lower lifeline anchor 651 to the area of thumb third joint 35 and wrist 74, than previous embodiments, the new externality causing inner hand structure I to avoid most of the bulging thumb base 30, not dispersing stress to the weaker upper area of thumb second joint 34, the surrounding anchors not being pushed out of position by the bulging thumb base 30, thus allowing thumb harness 654, lifeline anchor 652 and lower lifeline anchor 651 to remain firmly anchored in their receiving areas.

The success in holding mid hand cushion M and inner hand structure I more externally allows for a larger amount of space (pivot space 5 and anchor space 2) separating the inner, outer, upper and lower hand areas of hand grip structure. The larger amount of space allows greater flexibility of hand grip 600 allowing a full range of gripping motion while the exposed sensitive hand areas within pivot space 5 are untouched, being bridged over by handle 48.

Thus, hand grip 600 is a more three dimensional structure than previous upper hand grip 520, with the majority of the lower portion more successfully held externally of the palm area of the hand creating a spring-like cushion against the recoiling bat handle further reducing stress and potential bruising of the gripping hand than in previous embodiments.

Upper hand plane UP is similar in appearance in the drawings to previous upper web relocation press 517 but has substantial improvements later explained which create a more external forward area, upper hand bridging perimeter 686 capable of better cushioning and absorption of greater inertial handle force. In upper hand plane UP, outer web cushion 618 is now similar in structure and function to the area of mid hand cushion M in mid hand plane MP, in fact, the two forward and externally extending semi-planer structures (upper hand plane UP and mid hand plane MP) were similar to each other to the extent that various models during development between 600C and 600A could be inverted (upside down) and used in the opposite hand (left hand), thus embodiment 600B was created (shown for left hand usage in FIGS. 5 & 6)

SUMMARY OF THE INVENTION

One purpose of hand grip 600 is to support a bat handle outwardly in the gripping hand reducing the strength required and stress received by the fingers in holding the handle out in a proper finger grip when swinging a bat. Another purpose of hand grip 600 is protection of the hand's thumb bone against stinging and bruising caused by vibration of a bat handle due to a poorly struck baseball. Both purposes are easily accomplished by any thick padding, but not without impeding the normal grip and creating other types of discomfort to thumb tendons, ligaments and muscles, as well as middle finger/index finger tendons, because stress from the recoiling handle during the swing is now being disbursed to different areas of the hand than without such padding or device. Often this type of stress is not noticed by the user until several days of repeated swinging of a baseball bat, at which time discomfort begins to be noticed when gripping. In other words, the hand at first adapts to the structure, and then later it "un-adapts". The challenge of this and previous embodiments has been to provide the above benefits without causing any added stress to the gripping hand. A further goal which the inventor believes to have fully accomplished in the current embodiment is an actual lessening of overall stress to the hand resulting in a more powerful grip with increased control of the handle.

The basic structure of hand grip 600 exists in all four embodiments, with 600A and 600D the preferred embodiments by most hitters for top hand gripping, 600B the preferred embodiment for bottom hand gripping (shown for left hand usage in the drawings) and 600C being a precursor to the other three (A,B&D). Most descriptions of hand grip 600 apply to all embodiments. Unless noted otherwise however, descriptions would best be applied to embodiment 600A or 600D, both roughly identical except 600D branches inward from outer transverse anchor 663 extending to bridging perimeter 658 pressing into the hand's ring finger hollow 8 or into a lifeline anchor extension 664 connecting with lifeline anchor 652 (FIG. 13) both areas of extension enclosing anchor space 2 and accompanied by the extending of bridging perimeter 658 and all outer portions of mid hand cushion M lower and further outward.

Embodiment 600C (FIGS. 7&9) has been included because it shows the area of offset connection 668, lifeline anchor 652 and handle contact ridge 661 in their first discovered form which is a clearer, simpler form than later embodiments which have certain additions and refinements augmenting the performance but somewhat hiding the basic framework for hand grip 600. For instance, offset connection 668 is an evident structure in FIG. 7 (600C), but is noted with a dotted line in FIGS. 8&10. In 600C, handle contact ridge 661, the exterior side of lifeline anchor 652, protrudes externally and obviously but did not achieve the desired comfort level. In 600B, (FIGS. 5 & 6) the area of handle contact ridge 661 (the exterior of lifeline anchor 652) has a slight protrusion augmented by the grip. In 600A, the exterior of lifeline anchor 652 is planer and becomes only slightly ridge-like adjacent channel 657 from internal bending of channel 657 at offset connection 668 during the grip, the bracing/bridging power of 600A in the area of mid hand plane MP resulting from a tension created by the overall bending of thickened planer structure mid hand plane MP, and more arcing outer portion of mid hand plane MP, mid hand cushion M, (arcing externally and downwardly before receiving inertial handle force) a more complicated structure explained in the detail. In embodiment 600D, lifeline anchor extension 664 and it's formation of anchor space 2 (600D) enable handle contact ridge 661 in embodiment 600D to extend to a lower area of the hand than in 600C, and also to be angled more horizontally somewhat cam-like in it's approach and contact with handle 48.

Note: The upper portion, upper hand plane UP being interchangeable in embodiments 600A, C &D, has been excluded in FIGS. 8 & 10.

As in previous embodiments, hand grip 600 consists of anchors which rest or press against fleshy and/or tough areas of the hand bracing connecting structure bridging over sensitive hand areas and relocating (pushing) fleshy hand areas into more supporting positions of hand grip 600, thus hand grip 600 disburses stress from a handle into tougher/stronger hand areas and/or transfers power to the handle from tougher/stronger areas of the gripping hand, also increasing gripping control of the fingers and protecting thumb bones, joints and tendons not only by the material of hand grip 600 but by the hand's relocated, bulking fleshy areas (the hand itself).

Previous upper hand grip 520 was described as having a web anchor 581 resting against the upper, outer portion of the hand, and a thumb anchor 580 resting primarily against the inner portion of the hand. These two areas of the structure in past embodiments were delineated in order to explain the conflict resulting from structure connecting the outer hand (knuckle area holding the handle) moving rearward relative to the inner hand (thumb area and including the lower tough ball) moving downward and forward (outward) especially during phase two of the grip. These two structures are and must be integrally connected (except at pivot space 5 and anchor space 2) in order to create the necessary fleshy relocation and cushioning effect, and flexibility problems resulting from this connection in previous embodiments have now been overcome, even as the handle fully recoils in phase four pressing against outer structure in the upper hand creating no impediment to the inner hand's downward, forward movement. This due mainly to new external structure receiving inertial handle force in a lower area (mid hand) and a more external area (further outward in the fingers), reducing the impact of handle recoil in the upper hand and conflict with downward movement of the inner hand.

Although the above two described inner and outer areas still basically exist, a more complex current hand grip 600 may be depicted as having five main areas as described in a circular fashion: upper hand structure being upper hand plane UP, connecting inwardly with thumb joint anchor 622, extending downwardly connecting with inner hand structure I, extending further downwardly connecting with mid hand cushion M, extending outwardly connecting with outer hand structure O along the knuckle area (outer transverse anchor 663) extending upwardly to outer web cushion 618 integral with upper hand plane UP.

A simpler depiction views hand grip 600 in four basic areas: Two horizontal planer structures, upper hand plane UP and mid hand plane MP connected by two band-like vertical structures, thumb joint anchor 622 and outer transverse anchor 663, all together creating pivot space 5 which aids in allowing the hand to move through its full range of motion from phase one through phase four. Mid hand cushion M moves during gripping from basically planer to a more arcing structure (before handle pressure), joined with the more planer, inner hand structure I, the combined structures forming mid hand plane MP.

Shown in FIGS. 4&5, upper hand plane UP contains thumb/handle spacer 616, trough 613 (exterior to web pocket anchor 629 interiorly), outer web cushion 618 all integral with the forward/external upper hand bridging perimeter 686 and rear perimeter 688 (with further areas delineated in the specification). Web pocket anchor 629 presses within the hand's web pocket 48 relocating the fleshy area of the hand's upper web 46 downwardly increasing support of upper hand plane UP and protection of thumb second joint 34, and helping create the hand's web band 30B (FIG. 12) at the upper area of flesh roll 30A which extends from the hand's lower web 32 along thumb base 30. Trough 613, the exterior side of web pocket anchor 629, is angled in a certain manner and integral with additional structure to create a forward lift at upper hand bridging perimeter 686. Trough 613 providing flexibility while maintaining the thumb in an open/downward position (inhibiting lateral movement at the thumb second joint) and drawing pressure into the tough web area, not allowing lateral pressure to extend across to the sensitive index tendon and knuckle or downward to the thumb knuckle, while absorbing recoiling handle force into the hand's fleshy web area through direct handle contact with outer web cushion 618 integral with web pocket anchor 629.

Integral with trough 613 (and web pocket anchor 629 interiorly) thumb/handle spacer 616 extends partially atop the thumb to thumb joint anchor 622 adjacent the thumb first joint (FIGS. 1, 5 & 16), thumb joint anchor 622 wrapping partially around the area of thumb first joint 33 then downwardly connecting at spaced connection 607 roughly perpendicular to the internal planer side of deflector 609 turning the upper/outer edge of deflector 609 (thumb base lever 614) externally towards the handle. Deflector 609 extends downwardly becoming integral with thumb harness 654 pressing against a lower portion of thumb base 30 to lower lifeline anchor 651 pressing at bony (but tough) lifeline 37 toward the wrist. Deflector 609 and thumb harness 654 being inner hand structure I, a thick, planer structure. Inner hand structure I extends outwardly external of the palm connecting with mid hand cushion M containing such as primary handle contact 660 and ring finger trough anchor 662. Inner hand structure I and mid hand cushion M being mid hand plane MP. The upper/outer edge of deflector 609 is delineated as thumb base lever 614. Because thumb/handle spacer 616 and deflector 609 connect at right angles with thumb joint anchor 622, they are roughly parallel to each other when un-mounted, angling further apart outwardly when mounted in a gripping hand (FIGS. 1,9,13 & 15), with handle lever 615 (the leading edge of thumb/handle spacer 616) and thumb base lever 614 (the leading edge of deflector 609), both moving towards the handle and making partial contact with handle 48 depending on the grip, however both having the main purpose of leveraging and bracing handle contact area H in the outer hand, primarily an outer portion of mid hand cushion M (including primary handle contact 660), outer transverse anchor 663 and outer web cushion 618.

In embodiment 600B (FIGS. 5&6), mid hand plane MP is more clearly an inverted triangle, with the hypotenuse being bridging perimeter 658, mid hand plane MP having a foundational anchoring perimeter in the area of the legs of the inverted triangle, mid hand perimeter 650 and thumb harness perimeter 655.

As shown in FIGS. 1, 2, 7 & 8, an interior edge, mid hand perimeter 650, of mid hand cushion M presses against the hand's tough ball 13 & 38. Extending somewhat planer inwardly, upwardly and externally from mid hand perimeter 650, mid hand cushion M connects with inner hand structure I at offset connection 668 in roughly a straight line in embodiment 600C and an improved somewhat arcing line in later more preferred embodiments. Offset connection 668 extends from an outer end of thumb base lever 614 down to lower lifeline anchor 651. Mid hand cushion M is offset externally of inner hand structure I such that inner hand structure I braces mid hand cushion M externally toward handle 48. The connection between the two areas is refined in 600A, B & D such that it is not so apparent, but is clearly seen in 600C (FIGS. 7 & 9) exposing the upper/inner and external edge of mid hand cushion M as an external ridge (handle contact ridge 661), and exposing the outer/lower and internal edge of inner hand structure I (at offset connection 668) as an internal ridge (lifeline anchor 652). Lifeline anchor 652 is a visible ridge only in 600C, extending toward lower lifeline anchor 651 tapering in height becoming unapparent adjacent lower lifeline anchor 651. Lifeline anchor 652 is held externally of the hand by the described surrounding structure, but makes contact with the hand during gripping and inertial handle force pressing into the hand's lifeline trough 36A. The upper end of lifeline anchor 652 is delineated as thumb spread 626 pressing into the hand's lower web 32.

Primary handle contact 660 is an outer portion of bridging perimeter 658 of mid hand plane M and a lower portion of outer transverse anchor 663. A portion of primary handle contact 660 is also delineated as outer/mid connection 667A and junction 667 connecting with bridging perimeter 658 however it may be separated by space 2 from junction 667 when mid hand cushion M is located in a lower position such as in 600D. Outer transverse anchor 663 extending upwardly along the hand's outer transverse crease 12 towards upper hand plane UP. [In 600B, see FIGS. 5 & 6, outer transverse anchor 663 is shorter and angles inwardly from upper hand plane UP extending along lifeline trough 36A, outer/mid connection 667A located at a further inward portion of bridging perimeter 658 adjacent thumb base lever 614, leaving more space for a wider handle and follow through in bottom hand gripping at the area of mid hand cushion M.) The upper portion of outer transverse anchor 663 is integral with outer web cushion 618 which connects with upper hand bridging perimeter 686 of upper hand plane UP at index knuckle 21, an outer portion of outer web cushion 618 contouring index knuckle 21. Outer web cushion 618 is an important receiving area within handle contact area H explained in the specification. An inner side of outer web cushion 618 extends inward and internally becoming integral with the outer side of trough 613 (and web pocket anchor 629 interiorly) dipping into the hand's web pocket. An outer portion of thumb/handle spacer 616 angles outward and internally becoming integral with the inner side of trough 613 exteriorly and web pocket anchor 629 interiorly. In embodiment 600B, an inner portion of thumb/handle spacer 616 angles downward being integral with rear perimeter 688 and thumb joint anchor 622 (FIG. 5) aiding in creating a thumb recess 673 relieving pressure at thumb knuckle 34.

Thus, during the gripping and swinging motion, handle 48 is directly contacted and held outward in the gripping fingers largely by primary handle contact 660 and handle contact ridge 661 (outer portion of bridging perimeter 658) in the mid hand, by outer transverse anchor 663, and by outer web cushion 618 in the upper hand, such that handle 48 bridges over the hand's palm and sensitive tendon areas. Handle contact may also occur at handle lever 615 and thumb base lever 614. Although sensitive hand areas including an outer (web) portion of thumb knuckle 34 are left uncovered by pivot space 5, handle 48 is held externally and cushioned by the described surrounding structure and insulated by fleshy relocation of the hand itself.

BRIEF DESCRIPTION OF THE DRAWINGS

FIG. 5 is a front view of hand grip (embodiment 600B) positioned in a hand prior to gripping such that the area of 667A is further inward than during gripping.

FIG. 6 is a rear view of hand grip (embodiment 600B).

DETAILED DESCRIPTION OF THE INVENTION

Figure 11:
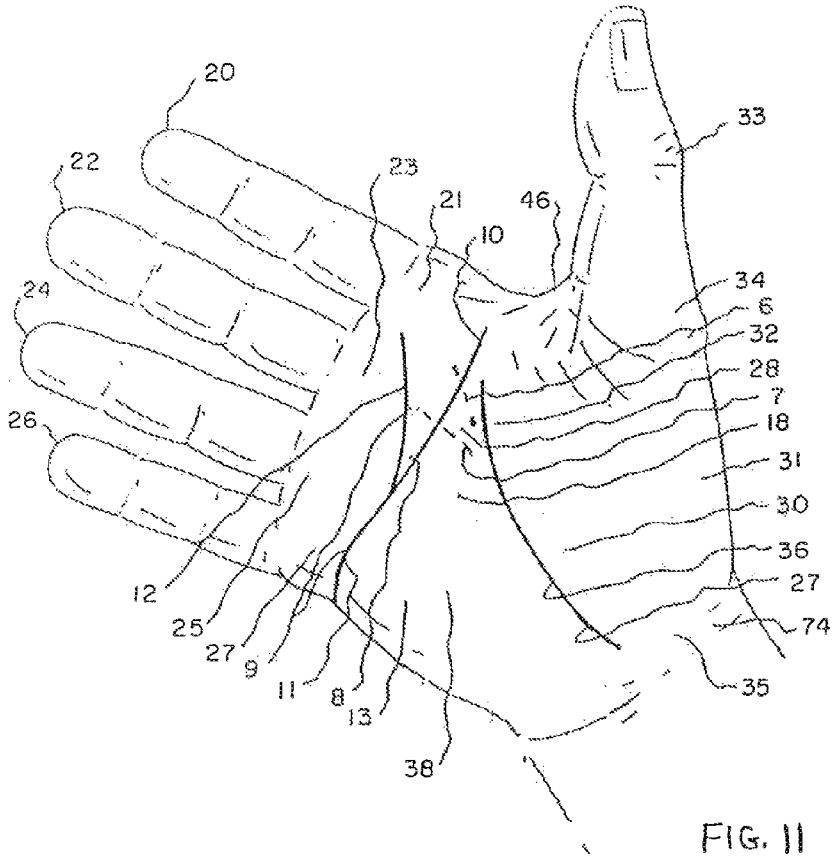
FIG. 11 is a view of an open face of a human hand identifying the areas of the hand that either work in conjunction with the invention or are necessary in understanding the gripping motion of the hand.
Figure 12:
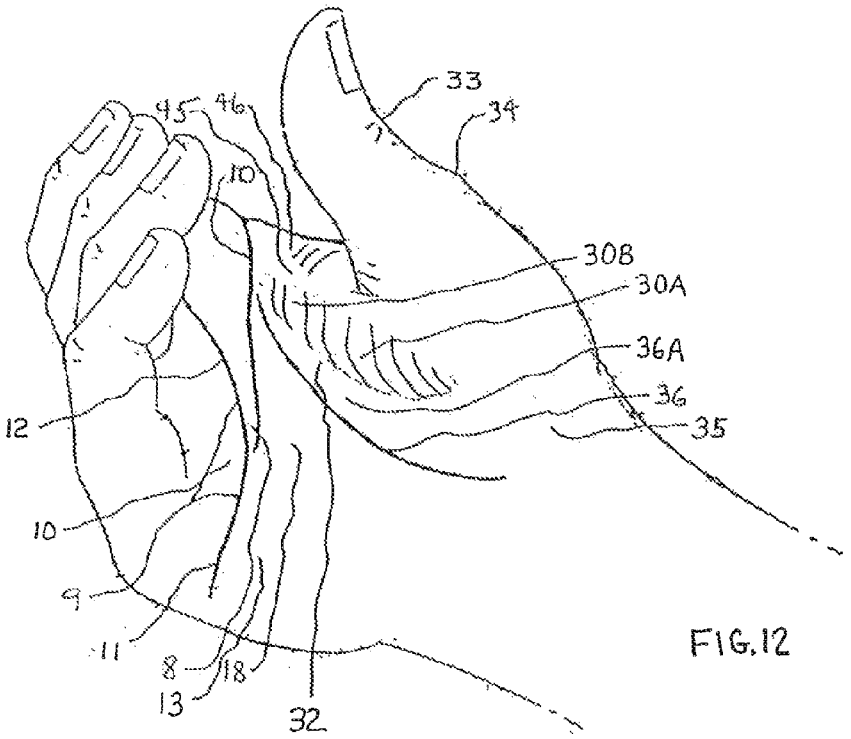
FIG. 12 is a view of a face of a human hand partially closed identifying the areas of the hand which either work in conjunction with the invention or are necessary in understanding the gripping motion of the hand.
Figure 13:
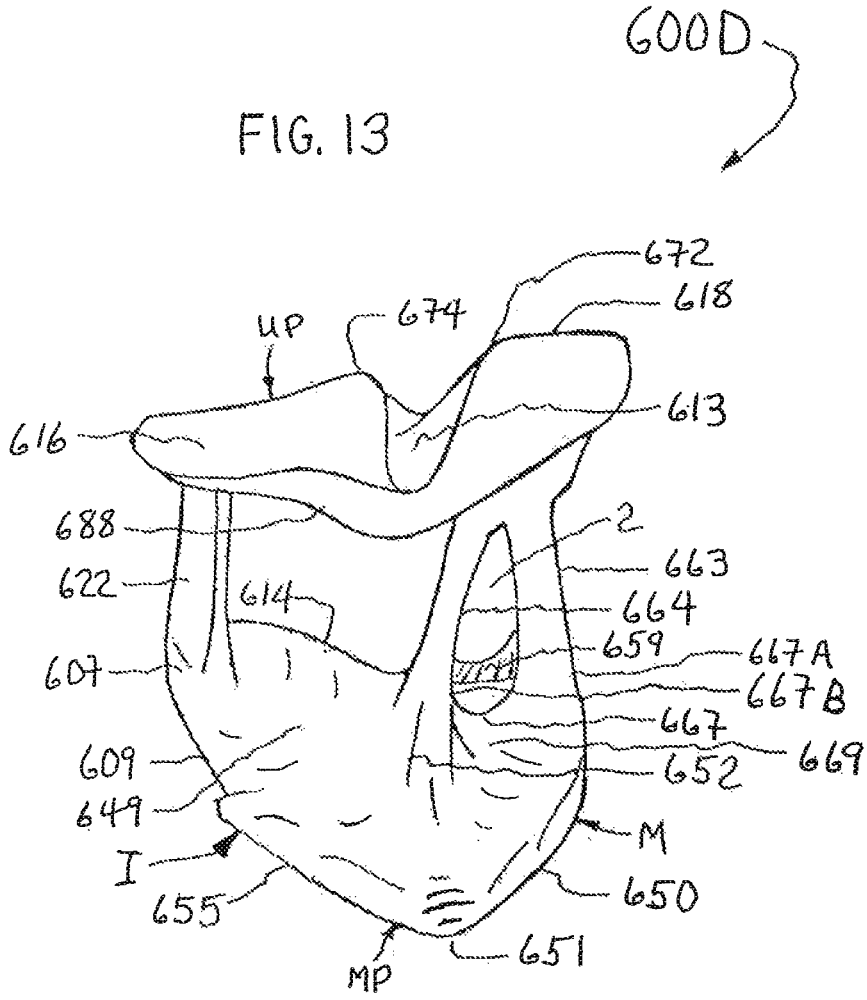
FIG. 13 is a rear view of hand grip (embodiment 600D).
Figure 14:
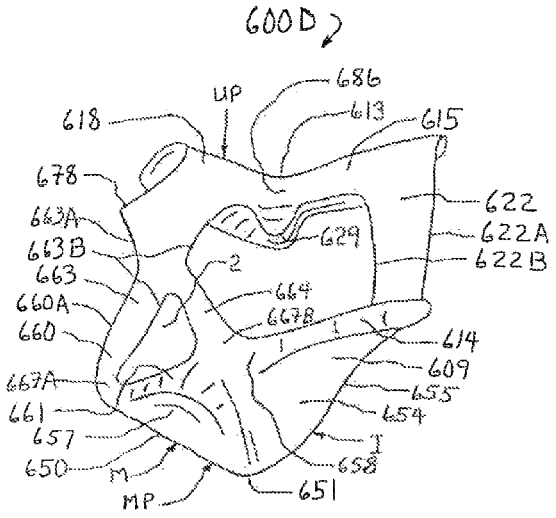
FIG. 14 is a front view of hand grip (embodiment 600D).
Figure 15:
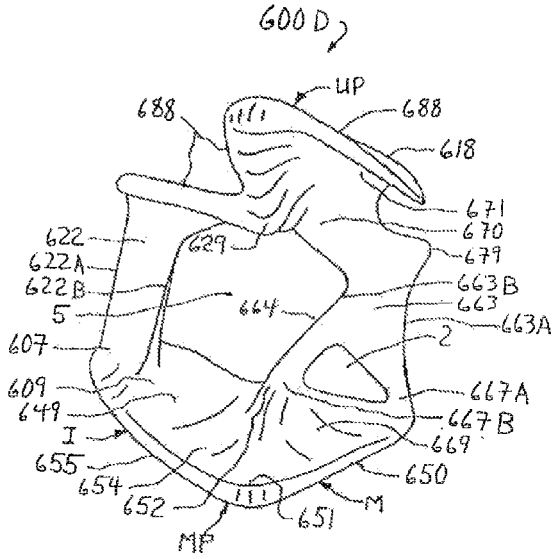
FIG. 15 is a rear view of hand grip (embodiment 600D) showing a version of upper hand plane UP with an inside, rear portion removed, making thumb/handle spacer 616 more clearly delineated.

Definition of directions and hand areas identified:

See FIGS. 11&12: Outward or forward is toward the fingers, inward is toward the wrist (so moving from the wrist to the palm is outward or forward). When describing the gripping motion, the inner hand in closing (moving downward, forward and upward) is the area inward of shift line 9 (transverse creases 11 and 12). When describing the location of structure, the inner hand is the area of the lower lifeline 27, thumb base 30, thumb third joint 35 and wrist, the outer hand being primarily the fingers and knuckles adjacent and outward of transverse creases 11 & 10. Upward or above is toward the upper hand. The upper hand is the area extending from thumb first and second joints (33&34) to index knuckle 21 including upper web 46, web pocket 48 and muscular ridge 47. Downward, lower or below is toward the mid hand. The mid hand is the area of the tough/lower palm (ring finger trough 18) and tough ball 38) and extending inward to the lower, bony (but tough) area of the lifeline, lower lifeline 37 (the upper and mid hand having overlapping areas with the inner and outer hand, the lower hand being the area occupied primarily by lower hand grip 510 of previous invention also overlapping with the mid hand). The outermost area of ring finger trough 18 is ring finger hollow 8 which is located at the intersection of lower transverse crease 11 and outer transverse crease 12 (branching outward/upward), the two creases delineating the area of shift line 9. Outward of shift line 9 is shift line support 10, a fleshy area which, under handle pressure is compacted inwardly/internally primarily at ring finger hollow 8 creating a natural cushion for the handle. Shift line support 10 is used to advantage as an anchoring area for outer transverse anchor 663 in hand grip 600. Lower web 32 and thumb base 30 are bordered by lifeline 36, a lower portion of thumb base 30 adjacent lifeline 36 is lifeline trough 36A, a lower (bony) lifeline 27 is a tough area adjacent/above a very sensitive bony heel 43 (hamete area). Between bony heel 43 and lower transverse crease 11 is a fleshy bulge 13 portion of the hand's tough ball 38. Web pocket 48 is an area within upper web 46 being forward and adjacent muscular ridge 47. Muscular ridge 47 is mostly unnoticeable unless the thumb is gripping laterally causing muscular contraction (not encouraged by hand grip 600). Web pocket 48 is somewhat crescent shaped arcing around a mid to rear portion of thumb second joint 34 mostly within the web such that it is not visible.

Exterior or external is away from the hand, interior or internal is toward the hand. An interior area of hand grip 600 being such as an anchor pressing against the hand or the underside of a bridge arcing above the hand. The opposite of the interior side is the front or exterior side contacting or facing the handle. Horizontal planer structure extends inwardly, outwardly, interiorly and exteriorly, vertical structure extends upwardly/downwardly or "lengthwise", "widthwise" meaning inwardly/outwardly.

Grip Analysis: If necessary, see previous U.S. Pat. No. 7,963,864 B2 by the current inventor for a more lengthy explanation of the gripping motion described in four stages, phase one through phase four. To summarize, full closing of the hand on a bat handle is not the result of just the fingers closing or the thumb moving laterally against the handle. It is the result of the entire inner hand (including the web, thumb base and tough ball) moving, and partially "slipping" primarily along shift line 9 (FIGS. 11&12) relative to the outer hand (knuckle, finger area holding the handle). It is a pivoting motion in which the inner hand moves downward and forward in phase 2 then further forward and slightly upward in phase 3 (not always in that order), then fully forward fully tightened, accordion-like rather than any apparent motion in phase four. Phase two is also characterized by a top hand tilt wherein the hand rolls over (inwardly) with the index finger knuckle (third joint) attempting to move inward in support of the handle which is being held out in the fingers (finger grip). (Phase two does not always precede phase 3, especially in the case of inside pitches or weight lifting, however in bottom hand gripping, a grip similar to phase two is the main grip throughout the swing, thus certain structure improving phase two gripping in current hand grip 600 has made it more suitable for bottom hand gripping.) Phase one is a relaxed finger grip with only partial tightening (before inertial handle force is received in the hand). Accommodating the phase two hand movement while maintaining the insulative thumb protection in the web area and altering stress reception down from the thumb/web area to the mid hand area without impeding the gripping motion has been the greatest challenge but now believed to be completely accomplished by the addition of new and reshaped structure.

To better describe the hand's desired and optimal inner hand movement the term "lateral" will be introduced to avoid confusion with "forward" meaning toward the fingers. Lateral will apply to thumb (or any) movement "sideways", (also toward the fingers) but more of a pincer motion mostly from the thumb second joint. Lateral movement of the thumb is unnecessary in gripping and swinging a baseball bat, and is inhibited by current hand grip 600. Benefits of reducing lateral thumb movement are 1) better spacing of thumb bone and knuckle joint 34 from handle 48 and hand grip 600 anchoring structure leaving more anchoring space for structure, 2) less muscle contraction at muscular ridge 47 providing more fleshy (softer) anchoring space at upper web 46 (atop and forward of muscular ridge 47) enhancing better fleshy relocation, and 3) augmenting the phase two "clockwise" gripping motion creating a more powerful grip. Benefits are further explained and demonstrated in previous patents by the current inventor. The thumb's angle of attachment to the hand at the thumb base, as well as "slippage" along transverse crease 10 & 11 (shift line 9) plus compaction of tendons creates a motion in gripping at the thumb base and inner hand that is naturally downward and outward/forward. This motion is necessary, must be a full range of motion and is not inhibited by hand grip 600, so this "forward" motion should not be confused with the undesired and inhibited "lateral" motion of the thumb.

[Note: A prologue contains a very minimum of grip analysis and definition of hand areas for the three independent claims, thus reference to the specification might be needed to understand the claims.]

Phases two through four occur when gripping against inertial handle force. In swinging a bat, once inertia is overcome and the bat is moving forward away from the hands, the knob end of the handle pivots inwardly moving along the hand's tough ball area (more so in the bottom hand) so structure that is comfortable before striking the ball (or before the follow-through) may become uncomfortable during the follow-through. Often a structure may be found to improve the top hand in gripping (right hand of a right handed hitter), but then found to be uncomfortable in the bottom (left) hand during the follow-through. Hand grip 600 is suitable for both top and bottom hands in swinging a baseball bat, with embodiment 600B the preferred bottom hand grip having a smaller less external mid hand plane MP, and less external arcing mid hand cushion M with primary handle contact 660 and handle contact ridge 661 moved inwardly to the lifeline area providing more space for a larger handle and for handle follow through.

Descriptions may be assumed to apply to embodiment 600A & 600D unless noted otherwise, however most descriptions apply to all embodiments.

Hand grip 600 is composed of a semi-rigid material allowing flexibility in some areas and rigidity in other areas, depending on the construction in those areas. Hand grip 600 is generally attached within a glove and constructed to conform with a human hand and flex through a full range of motion of the hand in the gripping of primarily straight, rounded handles such as the handle of a baseball bat, golf club, bar bell or other weight lifting device, also a hammer, bicycle handle or steering wheel. Hand grip 600 is designed to support a handle outward in a finger grip reducing stress to the gripping fingers, also to insulate and prevent soreness in the area of the hand's thumb bone, thumb knuckle, thumb muscles, index knuckle and finger tendons without impeding the desired grip. Hand grip 600 relieves stress in the hand by dispersing force of an inertial handle in swinging, or force from the handle of a heavy implement in lifting, through hand grip 600 to tougher, stronger and lower areas of the hand than without hand grip 600.

Hand grip 600 having anchors and bridging/connecting structure between the anchors, the anchors pressing into tough and/or fleshy areas of the hand under pressure of handle 48 or the gripping motion or an external glove. Anchors pressing primarily into hand areas of upper web 46, lower web 32, lifeline trough 36A, lower lifeline 27, ring finger hollow 8, ring finger trough 18, tough ball 38, and lower, inner areas of thumb base 30, the anchors bracing hand grip 600 and relocating and compacting fleshy areas of the hand providing protection for the hand and support for hand grip 600. Thus, while the wrong design will allow the structure to move out of place, the design of hand grip 600 takes advantage of skin displacement and is enhanced by the phenomenon, as well as the skin displacement and fleshy relocation provided by external pressure of a glove or portion of a glove. Hand grip 600 relocates the hand's upper web 46 downwardly and lower web 32 upwardly/inwardly creating (enhancing) flesh roll 30A and web band 30B (30B being an upper portion of 30A), flesh roll 30A (itself) providing protection for thumb second joint 34 and aiding in bracing structure of hand grip 600. Anchors also move with skin displacement during gripping and from inertial handle force into areas of lower web 32, lifeline trough 36A and ring finger trough 18. The upper portion of web band 30B is web apex 45, the area where lower web 32 meets upper web 46. During gripping, web apex 45 is the most forward extending area of the hand's web.

Some anchors are portions of a handle contact area H, some anchors are connected to and act in support of handle contact area H, some are a combination of the two. Handle contact area H is a large receiving area (direct handle contact area) located in primarily the outer hand and areas moving toward the outer hand including outer transverse anchor 663 and inward branch/lifeline anchor extension 664, outer portions of mid-hand cushion M, outer portions of bridging perimeter 658 of mid hand plane MP, and upper bridging perimeter 886 including outer web cushion 618 and handle lever 615 of upper hand plane UP. (Handle contact area H not called out in the drawings due its large area.) Areas of handle contact area H may or may not come into direct contact with the handle depending on type of grip, position of the hand and diameter of the handle. Lower portions of handle contact area H may absorb greater handle force during phase two gripping especially on low outside pitches or in golfing, thus the name "primary" in primary handle contact 660 within mid-hand cushion M, upper portions of handle contact area H absorbing greater handle force during phase three gripping especially on high inside pitches, the upper portions being outer web cushion 618 and handle lever 615 of upper hand bridging perimeter 686, however since all areas of hand grip 600 receive some degree of stress, each area to some degree supports every other area.

In appearance, as seen in an overall view as shown in FIGS. 1,2,7,9&13-15, hand grip 600 consists of two roughly horizontal semi-planer structures aligned roughly parallel to each other being spaced apart and having roughly perpendicular connections with two vertical bands. The two horizontal planer structures being an upper hand plane UP and a mid-hand plane MP, both somewhat planer but having arcing areas, (mid-hand plane MP having an exterior arcing portion within mid-hand cushion M attached to a more rigid and planer inner hand structure I, and upper hand plane UP having an exteriorly forward arcing outer web cushion 618 connecting with interior arcing trough 613 above upper web 46 bordered by mostly planer-like structure. The two vertical bands being primarily outer transverse anchor 663 and thumb joint anchor 622.

Note: The majority of mid hand plane MP is braced externally of the palm largely by an anchoring perimeter defined by mid hand perimeter 650 and thumb harness perimeter 655, mid hand perimeter 650 being the lower/outer and interior edge of mid-hand cushion M pressing into the area of the mid palm/tough ball, and thumb harness perimeter 655 being the inner and interior edge of inner hand structure I pressing against the inner thumb base. Thus in describing the external location and external elements of a structure it should be remembered there is also the interior side in roughly the same area, for instance, "mid-hand cushion M arcing externally and extending to the tough ball" at the same time that mid-hand perimeter 650 is anchoring against the tough ball.

First, a brief description of hand grip 600 encircling the front (face) of the hand, followed by a more detailed explanation of the various elements: Starting from the top, upper hand plane UP pressing downwardly atop the areas of upper web 46, thumb joints 33 & 34, index knuckle 21 and muscular ridge 47, extending forwardly and externally contouring and outer portion of index knuckle 21 as outer web cushion 618, extending downwardly as (vertical band) outer transverse anchor 663 with an outer edge 663A pressing adjacent the hand's outer transverse crease 12 (excluding 600B) and an inner edge, bridging edge 663B and majority of the band-like outer transverse anchor 663 angled and held externally of the palm connecting externally of the palm with bridging perimeter 658 of mid hand cushion M, the connection being an outer/mid connection 667A. [In embodiments 600A, C & D, outer/mid connection 667A is adjacent the hand's lower transverse crease 11, with handle 48 being held further out (forward) in the fingers than in bottom hand gripping, handle 48 braced by the externally arcing structure of mid hand cushion M. In 600B (preferred for bottom hand gripping) outer/mid connection 667A is integral with lifeline anchor 652 located further inwardly than 600A & D allowing more space for handle follow through. In 600B, mid hand cushion M is much thinner and less externally arcing than 600A,D&C. Embodiment 600D is a combination of A & B, with outer transverse anchor 663 branching to the two outer/mid connection areas, with the outer area noted as 667A and the inner area noted as 667B. Resuming the circular description, mid hand cushion M extending downwardly then arcing inwardly toward the wrist integrally joining lower lifeline anchor 651 pressing against lower lifeline 37. An inner/upper area of mid hand cushion M connects with inner hand structure I at an offset connection 668 mostly external of the hand until full grip. Of the two components of mid hand plane MP, inner hand structure I is larger and more planer than the more arcing mid hand cushion M, however together they act and gain spring or tension type strength from arcing structure, from planer structure bridging the palm and bracing strength from planer edge truss-like support (explained following). Resuming upwardly, inner hand structure I connects to (vertical band) thumb joint anchor 622 at a spaced connection 607, thumb joint anchor 622 then extending upwardly somewhat contouring the outside (web side) of the thumb and attaching to upper hand plane UP at the inner end of handle lever 615 and/or thumb/handle spacer 616 of upper bridging perimeter 686.

The encircling structure of hand grip 600 forming a large, pivot space 5, pivot space 5 exposing areas of the web and thumb, however the externality of inner hand structure I and bridging perimeter 658 of mid hand plane MP and externality of upper hand bridging perimeter 686 of upper hand plane UP in conjunction with surrounding structure bracing mid hand cushion M allows handle 48 to bridge over the exposed sensitive areas, pivot space 5 contributing to the described full range of motion from phase one through phase four, as upper, inner, and mid hand structure move forwardly/downwardly and forwardly/upwardly relative to outer hand structure and handle 48.

Within mid hand cushion M, primary handle contact 660 being a lowest portion of outer transverse anchor 663 extends downwardly, then inwardly, integrally extending as ring finger trough anchor 662 (upwardly of and similar to mid hand perimeter 650) to lower lifeline anchor 651 pressing against lower (bony) lifeline 37 towards the wrist at the innermost portion of mid hand cushion M and lowermost portion of inner hand structure I. In more recent embodiment 600D ring finger trough anchor 662 may be integral with inward branch 664 also known as primary contact extension 664, occupying the area of ring finger trough 18. Various structure within hand grip 600 creates an arcing cushion increasing during gripping as inner hand structure I moving downward and forward bracing and moving the exterior arc of mid hand cushion M and primary handle contact 660 to a lower area of contact with handle 48.

A further strengthening of primary handle contact 660 (excluding embodiment 600B) is gained by mid hand perimeter 650 joining integrally with outer edge 663A of outer transverse anchor 663 above the hand's shift line support, the area of integral joining being a shift line arc 660A, shift line arc 660A arcing above the hand's shift line 9 resting on and partially supported by the hand's fleshy protruding shift line support 10. Shift line arc 660A providing direct contact and support of handle 48. Shift line arc 660A when thickened and extending below upper tough ball 13 may eliminate a portion of the external arc of mid hand cushion M. An internal bending occurring during gripping (channel 657) arcing mostly widthwise, channel 657 being inward of primary handle contact 660, thus inner hand structure I and mid hand cushion M having integral synergy acting and gaining strength both as an arcing cushion and as a leveraging planer structure.

A further strengthening of primary handle contact 660 is gained by handle contact ridge 661, which is a thickened portion of bridging perimeter 658 in embodiments 600A & 600D, and a thickening of both bridging perimeter 658 and an external portion of lifeline anchor 652 in embodiments 600B & 600C, further detail following.

Mid hand cushion M (including integrally joined primary handle contact 660, ring finger trough anchor 662 and lower lifeline anchor 651), connects with inner hand structure I at offset connection 668, inner hand structure I extending inwardly/upwardly and, with the exception of thumb harness 654 and thumb harness perimeter 655, being mostly external of the hand during phase one, and having some portions external of the hand throughout the gripping motion. Inner hand structure I composed of deflector 609 integral with thumb harness 654. Thumb harness 654 extends upwardly from lower lifeline anchor 651 and thumb harness perimeter 650, with most of thumb harness 654 pressing against the hand's thumb base 30, however the external location of the upper area of inner hand structure I lifts an upper portion of thumb harness 654, externally of thumb base 30, there integrally extending as deflector 609. Upwardly, deflector 609 angles and extends or protrudes further externally. Outwardly, an outer edge of deflector 609 and bridging perimeter 658 extends to junction 667 (excluding 600B), junction 667 connecting to outer transverse anchor 663, portions of the planer interior of deflector 609 spaced below thumb first and second joints 33 & 34. Spaced connection 607 connects to the interior planer side of deflector 609 causing thumb joint anchor 622 to space deflector 609 downwardly and externally. Integrally joined thumb harness 654 and deflector 609 being a thick, planer structure with the exterior side of deflector 609 turned downwardly by spaced connection 609 angling the upper/external edge, thumb base lever 614, somewhat perpendicular and ninety degrees to handle 48, thus creating leverage and truss-like support outwardly and externally bracing mid hand cushion M, including primary handle contact 660 against inertial handle 48, with channel 657 (in embodiment 600B) junction 667, handle contact ridge 661 and outer portions of thumb base lever 614 also being areas of direct handle contact, as the majority of deflector 609 remains external of the hand in the upper area of thumb base 30, receiving an inward, upward, internal, and sometimes downward force from inertial handle 48.

Thumb joint anchor 622 extends from spaced connection 607 at the interior planer side of deflector 609 (the internal side facing upward toward the underside of the thumb). [Note: To simplify the call outs, the drawings show thumb joint anchor 622 long (high) and straight, being shorter and curved in actuality, such that upper hand plane UP angles lower from outside (index knuckle) to inside (thumb knuckle) creating greater anchoring pressure from web pocket anchor 629 downwardly and thumb spread 626 upwardly.] Thumb joint anchor 622 making contact with the thumb at the outer/forward side of the thumb (web side) extending upwardly adjacent thumb first joint 33 and connecting at roughly a right angle with the interior (lower) planer side of thumb/handle spacer 616 or the front edge (handle lever 615) such that thumb/handle spacer 616 and deflector 609 being roughly at right angles to thumb joint anchor 622 are roughly parallel to each other, thumb/handle spacer 616 being basically planer and somewhat contouring the thumb with a leading edge delineated as handle lever 615 (a portion of upper bridging perimeter 686), handle lever 615 moving outwardly toward handle 48 in a similar manner and purpose as thumb base lever 614, thumb/handle spacer 616 and deflector 609 being similar planer structures having leading edges moving outwardly in support of handle contact area H. Thumb/handle spacer 616 extends rearward along an outer upper area of the thumb, and outward to above (externally of) upper web 46 connecting with trough 613, thumb/handle spacer 616 having a thumb ridge 674 (in 600B) exteriorly above an outer area of the thumb knuckle. In embodiment 600B, a thumb recess 673 is located interiorly beneath thumb ridge 674, thumb recess 673 extending outwardly to a trough recess 675 at the interior side of trough 613 (more later).

Upper hand plane UP, composed of thumb/handle spacer 616 atop the thumb and upper web, outer web cushion 618 atop index knuckle 21 and upper web, and trough 613 exterior of web pocket anchor 629 atop upper web 46. Trough 613 extends rearward as a channel from the upper area of pivot space 5, bending forming a deeper channel during gripping, to rear perimeter 688 of upper hand plane UP, between and integral with thumb/handle spacer 616 inwardly and outer web cushion 618 outwardly, trough 613 having areas of various depths and angles described later. Trough 613 increases flexibility which aids in the following: 1) allowing full range of gripping motion especially the phase two motion, 2) increasing forward/internal skin displacement, as a rear portion of trough 613 "sinks" inwardly/forwardly due to downward/forward inner hand movement in gripping and due to external pressure from such as a glove, in turn creating a lift at a forward portion of trough 613 (described later) and 3) allowing a portion of the interior of trough 613, web pocket anchor 629 to move and bend within upper web 46 without impinging on thumb and index joints 34 & 21. Rear perimeter 688 extending from an inside area of thumb/handle spacer 616 thence behind trough 613 extending over muscular ridge 47 to outer web cushion 618, a portion of rear perimeter 688 becoming thumb ridge 674 as in FIGS. 15 & 16 (see Note below) such that pressure from an external glove braces trough 613 and outer web cushion 618, moving trough 613 (and web pocket anchor 629 interiorly], pressing into and relocating the hand's upper web 46, and bracing the arcing outer web cushion 618 downwardly against inertial handle 48. Note, thumb/handle spacer 616 may be clearly defined at its connecting area with trough 613, as in FIGS. 15 & 16, or it may be less defined when rear perimeter 688 is more U shaped, extending outward of thumb ridge 674 as in FIGS. 3, 4 & 6.

The interior side of trough 613, web pocket anchor 629 bends internally within the hand's web pocket 48 during phase two to phase four and under external pressure. Being integral with and located between thumb/handle spacer 616 and outer web cushion 618, the low/internal position of web pocket anchor 629 allows outer web cushion 618 to attach to upper hand plane UP in a lower area than without web pocket anchor 629/trough 613 which is critical in stabilizing outer web cushion 618 against upward force of inertial handle 48 (more later). In embodiment 600B, web pocket anchor 629 extending lengthwise rearwardly from a trough recess 675. Trough recess 675 (actually a recess in web pocket anchor 629), being the interior side of trough bridge 676, located roughly midway in trough 613 front to back. Trough bridge 676, a more shallow (less deep) portion of trough 613, extending above trough recess 675 between thumb ridge 674 and a rear portion of a index knuckle ridge 672 (more later). Web pocket anchor 629 pressing into the hand's web pocket extending rearwardly within upper web 46 becoming integral with a thickened portion of rear perimeter 688 of upper hand plane UP between thumb knuckle 34 and the rear end of muscular ridge 47. The lengthwise protrusion of web pocket anchor 629 being somewhat crescent shaped (similar to trough 613 exteriorly) adjacent thumb second joint 34 within upper web 46 aligning with the hand's web pocket 48. Web pocket anchor 629 further stabilizing upper hand plane UP and relocating and compacting the upper web 46 into a lower, denser, more protective position insulating the thumb second joint and bracing deflector 609 and upper hand bridging perimeter against the recoiling force of inertial handle 48. In embodiment 600B, a forward portion of trough recess 675 providing space for an upper portion of the hand's relocated/compacted upper web, preventing pressure building up at an area of index finger knuckle 21/tendon 6, trough recess 675 (in 600B) created partially by an angle within mid hand plane MP (trough bridge 676 near the apex) providing other benefits explained following. External pressure from a glove pressing down atop index knuckle ridge 672, thumb ridge 674 and rear perimeter 688 of upper hand plane MP, all increasing the cushioning support of handle lever 615 within upper hand bridging perimeter 686 and outer web cushion 618 against handle 48 in an area of direct handle contact, especially during extreme phase three of the grip on an inside pitch when the batter is "jammed", phase two of the grip being mostly skipped, such that the majority of inertial force from the handle as well as vibrational force from a poorly struck baseball (usually on the handle) is received in the upper portion of hand grip 600, making web pocket anchor 629 and surrounding structure very important in preventing stinging and thumb bruising on that type of swing. Thumb/handle spacer 616 in conjunction with trough 613 and web pocket anchor 629 working in conjunction with thumb spread 626 of mid hand plane MP also serving to inhibit lateral thumb motion thus spacing thumb second joint 34 a further distance from handle 48, thumb/handle spacer 616 also bracing the thumb, aiding the thumb in bracing thumb joint anchor 622 in turn bracing deflector 609 against the upward, inward or downward force of inertial handle 48. Handle lever 615 of thumb/handle spacer 616 making contact with handle 48 especially during phase three on inside pitches, but is secondary to outer web cushion 618 in receiving direct handle contact, with thumb joint anchor 622 and an outer portion of handle lever 615 making a shearing type contact (FIGS. 3 & 16) which is hardly felt by the user in supporting handle 48 outwardly of thumb second joint 34.

The combined structures of thumb base lever 614 (lower) and handle lever 615 (upper) create a tension that facilitates the described full range of gripping motion, propelling the inner hand forward and downward into a stronger closing position (inhibiting closing in the upper hand area), (the user feeling and receiving inertial handle force more in the stronger palm/wrist area than the upper weaker area of the hand) enhancing the previously described phase two clockwise motion.

Outer web cushion 618 contours index knuckle 21 externally and forwardly and downwardly connecting integrally with outer transverse anchor 663 between the hand's index knuckle 21 and middle finger knuckle 23 at nub 679. Interiorly, an outer portion of outer web cushion 618, knuckle mount 671, rests atop index finger knuckle 21 anchoring outer web cushion 618 and elevating an inner portion of outer web cushion 618, index cushion 670, above (externally of) an inner area of the index knuckle 21 and outer area of upper web 46. The described inner portion of outer web cushion 618 (index cushion 670 interiorly and index knuckle ridge 672 exteriorly, being located inwardly overlapping an outer portion of the hand's upper web 46. Index knuckle ridge 672 being integral with an upper end of the outer wall of trough 613, index cushion 670 being integral web pocket anchor 629, such that a forward portion of trough 613 is held externally of upper web 46, such that during phase one grip index cushion 670, the inner side of outer web cushion 618 arcs a half inch or more externally of web band 30B and index finger tendon 6 braced by the described surrounding structure. During phase two through four under inertial handle force, external pressure from a glove assists in preventing outer web cushion 618 from buckling backwards, however a portion of index cushion 670 does bend internally making contact with index knuckle 21 aiding knuckle mount 671 in bracing outer web cushion 618 and inner portions of upper hand bridging perimeter 686 externally of the hand, thus outer web cushion 618 acts as a cushion dispersing inertial handle force to upper hand plane UP, relieving stress to the areas of the thumb knuckle, index knuckle and tendons. Thus, handle 48 does not move into direct contact with trough 613, rather it is braced and cushioned externally of trough 613 by a lower portion of outer web cushion 618 and carried by the external bending outer web cushion 618 across trough 613 to handle lever 615 and thumb joint anchor 622 (FIGS. 3 & 13), thumb joint anchor 622 being at a right angle (during phase two-four) to the face of outer web cushion 618 contacting handle 48 in a shearing manner reducing stress to the upper hand (the weakest area of the hand), handle 48 making only residual contact with a front portion of trough 613.

Figure 1:
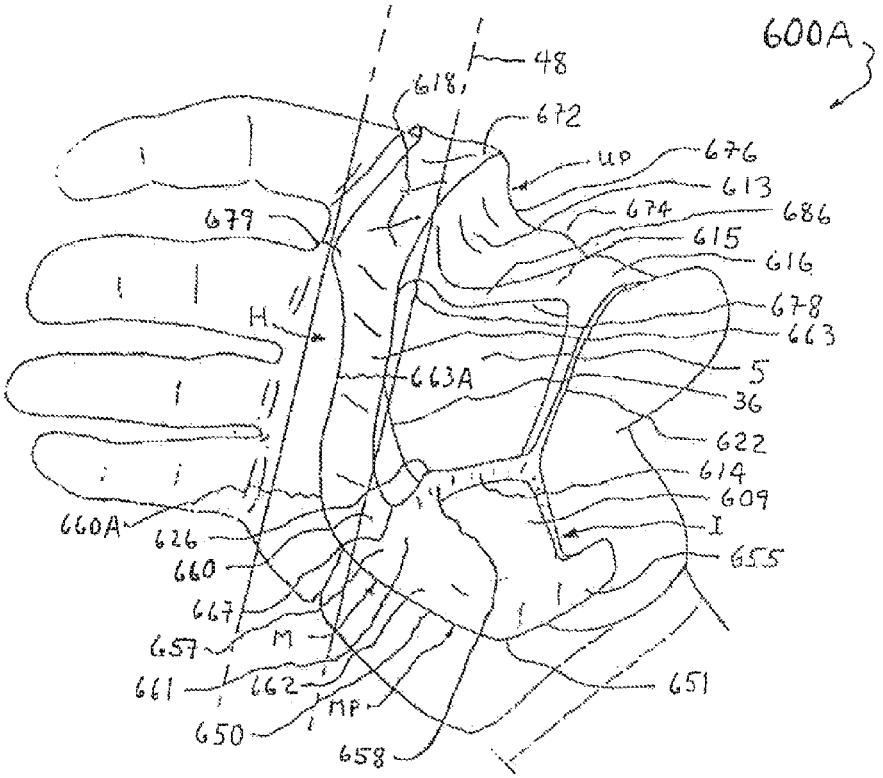
FIG. 1 is a partial front view looking upward at hand grip 600 positioned within an open hand such that certain handle contact areas have not yet come in contact with handle 48.
Figure 2:
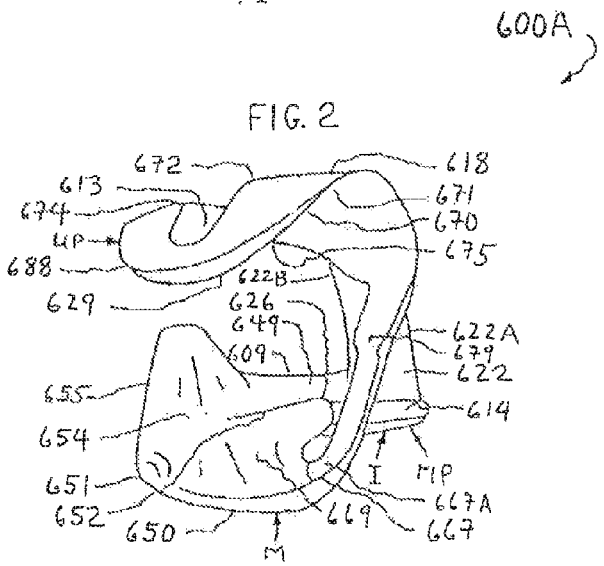
FIG. 2 is a side view looking at hand grip 600 from what would be the finger knuckle side of the hand.
Figure 3:
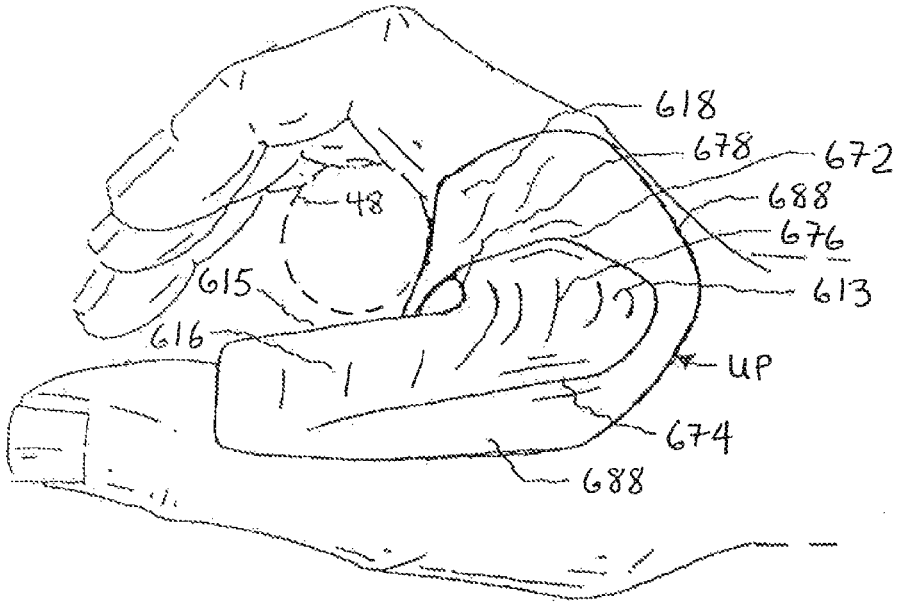
FIG. 3 is a top view of hand grip 600 positioned in a hand gripping a handle, demonstrating the forward movement of the inner hand when gripping, contrasted to FIG. 4.
Figure 4:
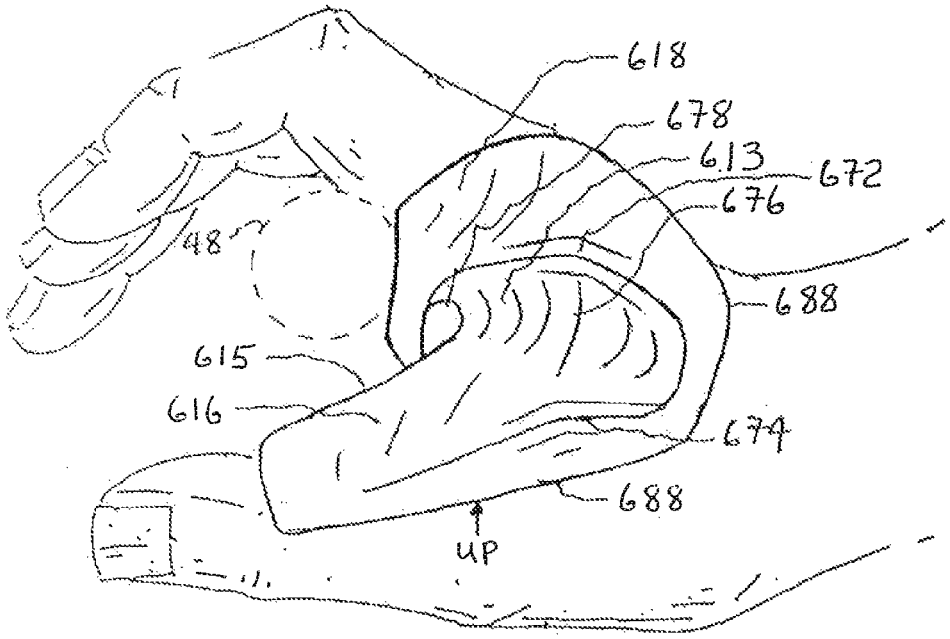
FIG. 4 is a top view of hand grip 600 positioned in a hand holding a handle prior to fully gripping the handle.
Figure 7:
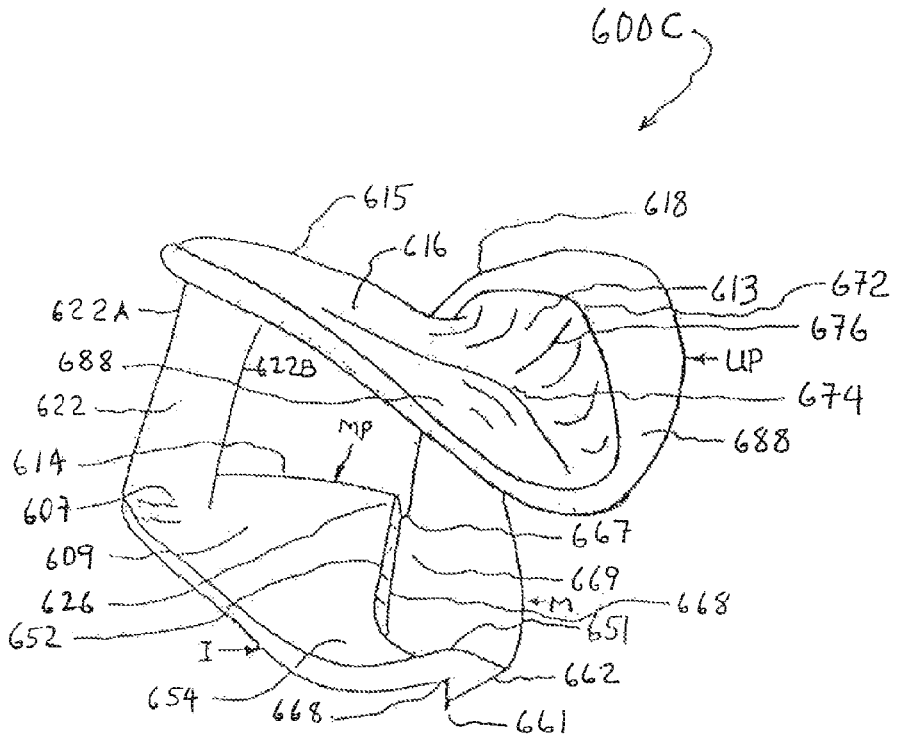
FIG. 7 is a rear, partial side view (thumb side) of hand grip (embodiment 600C) looking downward (the opposite view of FIG. 9.
Figure 8:
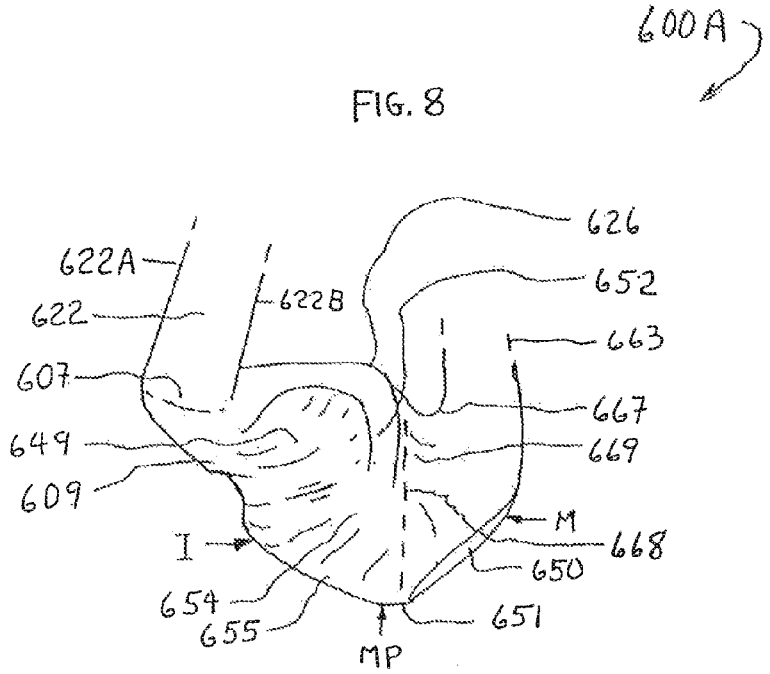
FIG. 8 is a rear view looking downward at mid hand plane MP of hand grip 600, upper hand plane UP being excluded.
Figure 9:
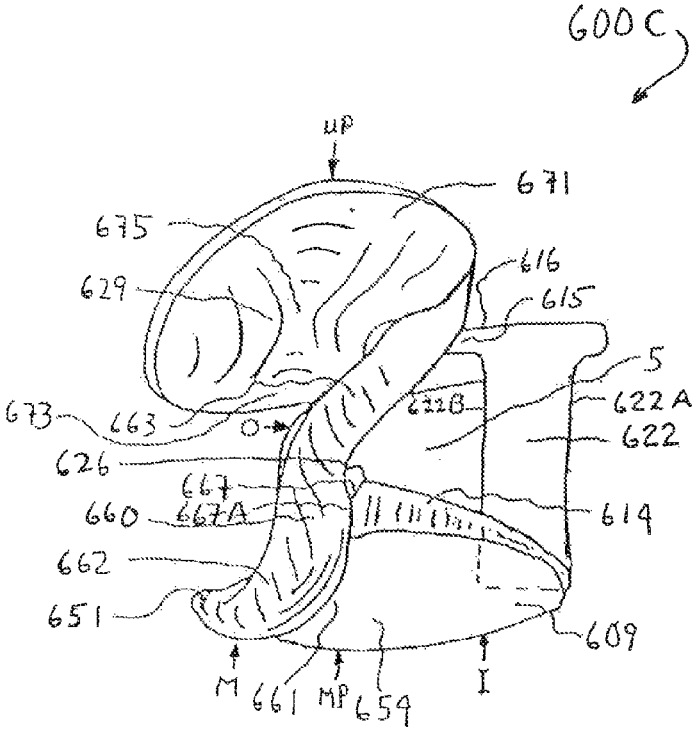
FIG. 9 is a front, partial side view (knuckle side) of hand grip (embodiment 600C) looking upward.
Figure 10:
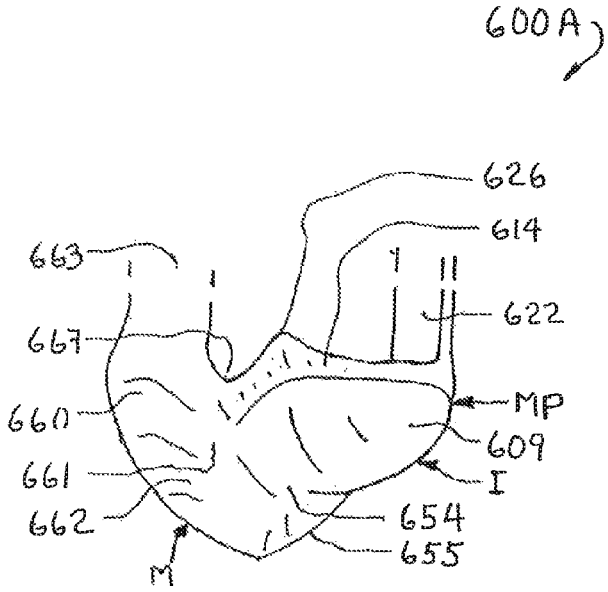
FIG. 10 is a front view looking upward at mid hand plane MP of hand grip 600, upper hand plane UP being excluded (the opposite of FIG. 8.
Figure 16:
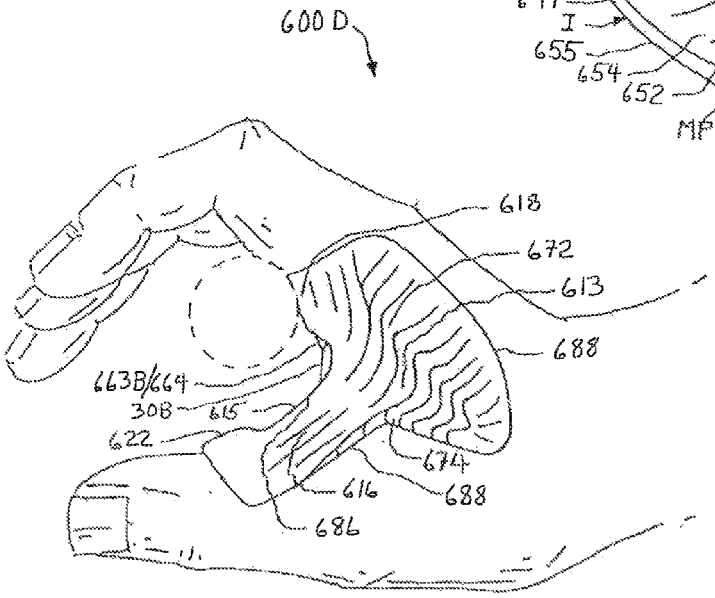
FIG. 16 is a top view with frontal exposure showing the hand's compacted web band 30B, hand grip 600 having an inside rear portion of upper hand plane UP removed such that thumb/handle spacer 616 is more clearly delineated.

Upper hand Plane UP of FIGS. 3, 4 & 16 may be used interchangeably on embodiments A, C & D. In comparing FIG. 16 with FIGS. 3 & 4, an inner/rear portion of upper hand plane UP is removed making thumb ridge 674 a portion of rear perimeter 688 and revealing a clearer area of connection of thumb/handle spacer 616 to trough 613 at roughly a right angle (when not gripping) and showing thumb/handle spacer 616 being more interior than outer web cushion 618. Index knuckle ridge 672 extends from outer web cushion 618 to rear perimeter 688 and serves a similar function as thumb ridge 674. Index knuckle ridge 672 and thumb ridge 674 causing rear perimeter 688 to extend upwardly of the hand (when not under a glove) such that when under external pressure of a glove, the glove presses index knuckle ridge 672 and thumb ridge 674 downwardly firmly anchoring web pocket anchor 629 within the upper web causing web pocket anchor 629 to act as a fulcrum as in a teeter totter with the external pressure of the glove at rear perimeter 688 creating a lift at a forward end of index knuckle ridge 672 supporting upper hand bridging perimeter 686 against inertial handle force.

This paragraph pertains to embodiment 600B:

Trough 613 having a lengthwise arc (front to back) due to a tilt, the tilt being an angle within upper hand plane UP crosswise to trough 613 such that rearward portions of mid hand plane MP tilt downwardly (opposite of 600A & D). Rear perimeter 688 inwardly of thumb ridge 674 also angling downwardly aiding thumb recess 673 in providing clearance for thumb knuckle 34, thumb recess 673 integral with trough recess 675 also reducing stress to sensitive tissue inward of index knuckle 21. Thumb ridge 674 of thumb/handle spacer 616, extending rearwardly partially parallel and angling towards trough 613, thumb ridge 674 having a thumb apex above and outward of thumb knuckle 34, the thumb apex being integral with an upper portion of the inner wall of trough 613, trough bridge 676 extending between the thumb apex of thumb ridge 674 across trough 613 to a knuckle apex of index knuckle ridge 672, the knuckle apex being above and inward of index finger knuckle 21, trough bridge 676 located exteriorly of trough recess 675, trough bridge 676 being within the channel of trough 613 but a less internal portion of the channel of trough 613, trough bridge 676, and the apexes of thumb ridge 674 and index knuckle ridge 672 being at the apex of the tilt (the angle in upper hand plane UP crosswise to trough 613), trough recess 675 enhanced by trough bridge 676 and by the crosswise tilt of upper hand plane UP, an external pressure of a glove at the apexes of thumb ridge 674 and index knuckle ridge 672 forcing web pocket anchor 629 and portions of upper hand plane UP rearward of trough bridge 676 to move interiorly, a combination of the described structure allowing the rearward interior movement creating a lift in a forward area of trough 613, the lift aiding in elevating a forward portion of upper hand plane UP externally of sensitive knuckle portions surrounding and integral with the hand's upper web 46.

In embodiments 600 A & B, a forward, outer edge of trough 613 connects with outer web cushion 618 at pivot 678. Pivot 678 being similar to junction 667 of mid hand plane MP, pivot 678 in conjunction with trough 613 facilitating a flexibility allowing the described gripping motion including top hand tilt. Pivot 678 however, generally not receiving direct handle contact as does junction 667. An interior portion of pivot 678 being a forward, outer portion of the interior of trough 613 and, integral with index cushion 670, assisting knuckle mount 671 in bracing middle to inner portions of trough 613 and thumb/handle spacer 616 externally of upper web 46 and thumb knuckle 34 at the described forward extension of upper hand plane during gripping and inertial handle contact. In embodiment 600D, outer web cushion 618 is wider, extending further inwardly somewhat overlapping the front of trough 613 eliminating pivot 678 such that the inside edge of outer web cushion 618 (integral with the inside bridging edge of outer transverse anchor 663B) connects integrally at the front edge of trough 613 more to the inside of trough 613 becoming the front edge of trough 613.

Outer transverse anchor 663 extending downward connecting with primary handle contact 660. Outer transverse anchor 663 is anchored largely by pressure from handle 48 itself, pressing against outer edge 663A in the relatively stationary outer hand such that outer transverse anchor 663 in turn serves to stabilize upper, inner and mid hand structures within their proper anchoring positions as upper, inner and mid hand structure move downwardly, forwardly (outwardly) and upwardly relative to handle 48 and outer transverse anchor 663.

In embodiment 600D, outer transverse anchor 663 having an inward branching creating a second lower end of outer transverse anchor 663 having a second outer/mid connection 667B with bridging perimeter 658 of mid hand plane MP, second outer/mid connection 667B located upwardly of channel 657, the described inward branching being named a lifeline anchor extension 664 when located and pressing within the hand's lifeline trough 36A at an area upwardly of the anchoring area of lifeline anchor 652, or named inward branch 664 when extending inwardly at the area of the hand's ring finger hollow 8 absorbing recoiling handle force in a lower area of the hand, inward branch 664 further dissipating inertial handle force into lower and tougher receiving areas of the hand. A space being created between outer transverse anchor 663 and inward branch 664 or (lifeline anchor extension 664) the space being an anchor space 2. When inward branch 664 extends inwardly at the ring finger hollow 8, hand grip 600 extends to a lower area of the hand (lower hand grip 510 or bridge 540 of lower hand grip 510 not occupying the hand's tough ball 38 area) with anchor space 2 extending further downwardly and outwardly, anchor space 2 occupying the area of or being a portion of channel 657. Inward branch 664 or lifeline anchor extension 664 may be unnoticeable when a widening of outer web cushion 618 integral with outer transverse crease 663 cause bridging edge 663B to connect with bridging perimeter 658 at the area of second outer/mid connection 667B, anchor space 2 also allowing easier more complete range of motion of the inner hand during gripping and causing bridging perimeter 658 to move further outwardly and an outer portion of mid hand perimeter to arc further externally/downwardly contacting handle 48 in a stronger leveraging position.

A portion of anchor space 2 may be filled making a portion of lifeline anchor extension 664 or inward branch 664 and outer transverse anchor 663 a single structure, the single structure being a primary contact extension 659 (see FIG. 17), primary contact extension 659 having the properties and benefits of outer transverse anchor 663 and primary handle contact 660 with added support from the hand's ring finger hollow and/or lifeline trough.

A rearward, interior edge of thumb joint anchor 622 (also an inner portion of pivot space 5) is interior edge 622B. The forward, exterior edge of thumb joint anchor 622 is exterior edge 622A. Thumb joint anchor 622 connects with the interior plane of deflector 609 spaced below thumb first joint 33 at spaced connection 607 in a line of attachment from the lower end of exterior edge 622A (at spaced connection 607) to the lower end of interior edge 622B allowing a widthwise swiveling of deflector 609 as the external pressure of a glove forces the inner rounded edge upwardly cushioning between first and second thumb joints 33 & 34, while an outer portion with an inner area of thumb base lever 614 moves downwardly somewhat curving to a stronger position helping create the described perpendicular angle towards handle 48 bracing primary handle contact 660 from a position further downward and exterior against inertial handle 48. The same phenomenon of the widthwise swiveling of deflector 609 may be gained of thumb/handle spacer 616 as in embodiment 600B (FIG. 5), wherein thumb joint anchor 622 attaches upwardly to thumb/handle spacer 616 at an upper spaced connection 607A, the line of attachment being similar to the above described line of attachment of spaced connection 607 and slightly more inward, such that thumb/handle spacer 616 swivels with outer edge portion handle lever 615 dipping downward contacting handle 48 at more of a forty five degree angle at a lower position creating added cushioning at handle lever 615 and bracing thumb/handle spacer 616 outwardly of a sensitive inner portion of thumb knuckle 34.

An outer end of bridging perimeter 658 connects at different areas of outer transverse anchor 663 depending on the embodiment, the connection usually noted as junction 667 adjacent primary handle contact 660 at the lowest inside edge (bridging edge 663B) of outer transverse anchor 663 (excluding 600B). Internally of junction 667 of mid hand cushion M, recess 669 is formed which allows clearance for portions of the hand's little finger, ring finger and middle finger tendons. An area of connection extends adjacent and outwardly of lifeline anchor 652 from bridging perimeter 658 towards lower lifeline anchor 651, most of the length of the area of connection between mid hand cushion M and inner hand structure I and is known as offset connection 668. The area of offset connection 668, lifeline anchor 652 is more easily understood viewing embodiment 600C (FIGS. 7&9) and is not so readily apparent in embodiments 600A,B&D: In 600C, offset connection 668 forms an external ridge and an internal ridge, the external ridge being a base portion of handle contact ridge 661, the internal ridge being lifeline anchor 652. A base portion of handle contact ridge 661 and lifeline anchor 652 being the result of offset connection 668 which is the result of inner hand structure I being located interiorly of (closer to the hand than) mid hand cushion M, with the inner hand structure I of thumb harness 654 and deflector 609 aiding in bracing mid hand cushion M externally of sensitive finger tendons against the force of inertial handle 48 without impinging on the thumb or inhibiting downward motion of the thumb base and inner hand.

Handle contact ridge 661 arcs externally of lifeline anchor 652 reinforcing mid hand cushion M and inner hand structure I against the force of inertial handle 48. Handle contact ridge 661 visibly protrudes in embodiment 600C but is not apparent in 600A&B, being a slightly thickened area of mid hand cushion M due to and supported internally by lifeline anchor 652. In embodiment 600D, handle contact ridge 661 combines features of 600A and 600C, having the arcing planer area at the exterior of lifeline anchor 652 as in 600A combined with an external protrusion similar to 600C, lifeline anchor extension 664 and it's creation of anchor space 2 (600D) enabling handle contact ridge 661 in embodiment 600D to extend to a lower and more outward area of the hand than in 600C, and also to be angled slightly horizontally, somewhat cam-like in it's approach and contact with handle 48.

Lifeline anchor 652 (the internal ridge) is the outer area of integrally connected thumb base lever 614, deflector 609 and thumb harness 654 (inner hand structure I). Lifeline anchor 652 extends toward lower lifeline anchor 651 as a ridge diminishing in height in the area of lower lifeline anchor 651 (apparent only in 600C, see FIG. 7). Lifeline anchor 652 is exterior of the hand's lifeline during phase one (relaxed) grip, however during gripping an internal bending occurs along and outward of offset connection 668, with the angle of offset connection 668 producing an inward turning of lifeline anchor 652 avoiding the sensitive middle and index finger tendons, the inward turning of lifeline anchor 652 allowing a hooking approach toward the base of the closing thumb during gripping, with lifeline anchor 652 pressing snugly into the hand's lifeline trough 36A/lower web 32 while avoiding surrounding sensitive portions of the hand, the upper area of lifeline anchor 652 extending further interiorly connecting with bridging edge 663B further delineated as thumb spread 626 wherein a lower portion of bridging edge 663B may act as thumb spread 626 within lifeline anchor 652, lifeline anchor 652 augmenting thumb spreading and aiding in bracing primary handle contact 660 and adjacent structure externally of sensitive tendons and bones against inertial handle 48, the thumb spreading maintaining the thumb spaced a further distance from the handle, providing more space for anchoring (avoiding tendons) within the web and allowing a greater transfer of power from the stronger thumb third joint/wrist area (explanation in the preceding patent).

Junction 667 and offset connection 668 with recess 669 (FIG. 7) also aid in allowing a forward flexing of mid hand cushion M relative to outer transverse anchor 663 during the gripping motion, outer transverse anchor 663 being stationary under handle 48 relative to mid hand cushion M moving forwardly to contact handle 48 in a lower area than would be possible without the described forward flexing, forward flexing enhanced by channel 657 or space 2 forwardly of lifeline anchor also aiding in allowing the inner hand to move fully forward/downward during phase two. The interior side of deflector 609 having a slightly concave portion which is enhanced by thumb harness perimeter 655 and the internal protrusion of thumb spread 626 and lower lifeline anchor 651 and the externally angled protruding deflector 609 creating a planer recess 649 at the interior (upward facing planer side) of deflector 609, planer recess 649 enhancing forward flexing and providing space for the most prominent forward bulging muscle of the hand's thumb base. Thumb harness perimeter 655 and lower lifeline anchor 651 (adjacent the hand's sensitive bony heel) create additional bracing of ring finger trough anchor 662 in protection of bony heel 43 and the hand's finger tendons, and in conjunction with planer recess 649 also increasing the amount of inertial handle force being dispersed to lower lifeline anchor 651 and the inside edge of thumb harness 654 (through thumb harness perimeter 655) reducing stress to the thumb and strengthening handle contact area H. The lower and further external location of the externally angled deflector 609 improves the effectiveness in bracing mid-hand cushion M against inertial handle 48, and also locates thumb base lever 614 not bumping the ends of any fingers.

In embodiment 600C, the base of handle contact ridge 661 being an outside edge area of inner hand structure I (exterior of lifeline anchor 652) may protrude and taper to a thin external edge (as in embodiment 600C, FIG. 9) wherein portions of the thin external edge of handle contract ridge 661 extending from ring finger trough anchor 662 arc forwardly and upwardly moving into contact with handle 48 in a still lower position than primary handle contact 660, further widening the effective grip of the hand, the outside edge of the thin external edge of handle contact ridge 661 contacting, flexing to conform with and press outwardly against handle 48, braced by ring finger trough anchor 662, lower lifeline anchor 651, thumb harness 654 and the described upward connecting external structure. Hand grip 600 is useable in both top and bottom hand gripping in swinging a baseball bat and it should be understood that hand grip 600 may be built with handle contact ridge 661 located in a lower area and/or more external area and be workable in top hand gripping (right hand for right handed hitter) but not as comfortable or workable in bottom (left) hand gripping.

Hand grip 600 may be used separately or in conjunction with lower hand grip 520 within hand accessory 500. Current hand grip 600 extends to a lower area of the hand than former upper hand grip 580, such that lower portions of lower lifeline anchor 651 and mid hand perimeter 650 within current hand grip 600 overlap the upper edges of thumb buffer 548 and bridge 540 of lower hand grip 520.

Hand grip 600 may be joined with lower hand grip 520, the two becoming one structure as in most previous embodiments before embodiment 500D of hand accessory 500. The joined area being a lower edge of mid hand perimeter 650 with an upper edge portion of fulcrum platform 502, eliminating bridge 540 and thumb buffer 548 of lower hand grip 520.

It should be understood that mid hand perimeter 650 may be located in a lower area of the hand, that is, primary handle contact 660 may extend downward to the bottom of the hand before turning inward towards lower lifeline anchor 651.

It should be understood that when hand grip 600 is enclosed under external pressure of a glove, various connecting areas could be disconnected or partially eliminated and be held in place by the glove. In such a case, the glove itself (or any covering) should be considered to be the element of the structure that was eliminated, thus the current invention not circumvented.

What is claimed is:

1. In combination with a handle of an implement when said handle is to be manually swung in motion or lifted by a bare or gloved gripping hand of a human, initial forward movement of said handle by the hand creating an inertial handle force against the hand, the outer hand being the knuckles and fingers bordered inwardly by a transverse crease, the inner hand being inward of the transverse crease, a ring finger hollow located at an intersection of a lower transverse crease and an outer branching transverse crease, the two creases together being a shift line, outwardly of the shift line a fleshy area of the hand being a shift line support adjacent the ring finger hollow, the hand having a gripping motion when swinging a baseball bat wherein the inner hand moves outwardly (forwardly) and downwardly and/or upwardly in relation to the shift line and said handle, a hand grip constructed to conform with the hand and said gripping motion of said hand, a handle contact area within said hand grip making direct contact with said handle, portions of said handle contact area receiving varying degrees of said inertial handle force, said hand grip having a plurality of anchors, said anchors resting or pressing against tough or fleshy areas of the hand, some of said anchors being a portion of said handle contact area, some of said anchors acting to support and brace said handle contact area, a middle portion of said handle contact area being an outer transverse anchor extending vertically adjacent the outer hand, a lower portion of said handle contact area below and integral with said outer transverse anchor being an outer portion of a mid-hand cushion, an upper portion of said handle contact area above and integral with said outer transverse anchor being an outer web cushion, said outer web cushion being an outer portion of an upper hand plane, said mid hand cushion being an outer/lower portion of a mid-hand plane, said mid hand plane having a lower edge area and an inner edge area, said lower edge area being a mid hand perimeter, said mid hand perimeter anchoring primarily at the tough ball, said inner edge area being a thumb harness perimeter, said thumb harness perimeter anchoring primarily at the thumb base, said mid hand perimeter of said mid hand cushion extending from adjacent and outward of the lower transverse crease to a lower lifeline anchor, said thumb harness perimeter extending from said lower lifeline anchor upwardly along the thumb base, said thumb harness perimeter being a portion of an inner hand structure, said inner hand structure occupying an inner/upper portion of said mid hand plane, said mid hand cushion being integrally joined with said inner hand structure at an offset connection, said offset connection being an area of internal bending during said gripping motion, said mid hand plane having and an upper portion adjacent the palm, portions of said upper portion being external of the palm before said inertial handle force, said upper hand plane being a semi-planer structure having an interior side resting atop the area of the upper hand facing downward, said upper hand plane having an area of internal arcing above the upper web such that said interior side extends within the upper web during gripping, an exterior side of said internal arcing above the upper web being a trough, said upper hand plane having areas of external arcing above the index knuckle (third joint) and thumb knuckle (second joint) during gripping, said mid hand plane having an upper edge portion of said upper portion of said mid hand plane, said upper edge portion being a bridging perimeter, said bridging perimeter extending from adjacent the thumb outwardly across the palm to said handle contact area, within said upper hand plane said outer web cushion being a portion of said external arcing adjacent the index knuckle, said outer web cushion integrally extending forwardly from said upper hand plane and downwardly to said outer transverse anchor, said outer transverse anchor extending further downward connecting to said bridging perimeter of said mid hand plane at an outer/mid connection, an upper portion of said inner hand structure within said mid hand plane being a deflector, an upper portion of said deflector having a spaced connection with a thumb joint anchor, said spaced connection located adjacent the bottom of the thumb first joint, said thumb joint anchor extending upwardly from said spaced connection adjacent the thumb and connecting atop the thumb to said upper hand plane, said thumb joint anchor aiding in spacing portions of said deflector of said inner hand structure of said mid hand plane externally of the thumb, said upper hand plane, said mid hand plane, said thumb joint anchor and said outer transverse anchor creating a pivot space, said pivot space aiding flexibility required for said gripping motion.

2. The hand grip as defined in claim 1 wherein:

said deflector of said inner hand structure having an external location partially due to said spaced connection with said thumb joint anchor spacing said deflector downward and partially external of the palm locating and angling an upper and external edge of said deflector of said inner hand structure more external of said offset connection aiding in locating and bracing said upper portion of said mid hand plane in an outward, external position and a more downwardly position than without said spacing, strengthening said handle contact area against upward/inward said inertial handle force, said upper and external edge of said deflector being a thumb base lever, said thumb base lever being an inner portion of said bridging perimeter of said mid hand plane, said thumb base lever being a leading edge of said planer said inner hand structure moving during said gripping motion forwardly toward said handle bracing said handle contact area against said inertial handle force.

3. The hand grip as defined in claim 2 wherein:

said thumb joint anchor extending from said spaced connection with said deflector wrapping partially around the outside (web side) of the thumb adjacent the thumb first joint, said thumb joint anchor connecting upwardly with a thumb/handle spacer, said thumb/handle spacer resting against an outer, upper portion of the thumb and being a portion of said upper hand plane, said thumb/handle spacer aiding in inhibiting lateral thumb motion and enhancing clockwise motion of the hand spacing the thumb second joint a further distance from said handle than without said thumb/handle spacer, a forward (leading) portion of said thumb/handle spacer being a handle lever, a portion of said handle lever making direct contact with said handle during gripping, said direct contact being greater during said upward motion of said gripping motion especially on high/inside pitches, said thumb/handle spacer extending outwardly, interiorly, and integrally to an inner wall of said trough, said trough being a channel extending rearwardly from an upper area of said pivot space, a forward portion of said trough extending above (externally of) the hand's web apex, a web pocket anchor being at said interior side of said trough, said trough allowing said web pocket anchor to flex, said trough aiding in enabling said external pressure (of said glove) above said upper hand plane pressing said web pocket anchor interiorly to lift a forward portion of said trough, a rear perimeter extending from an outer rear portion of said outer web cushion wrapping around the rear of said upper hand plane extending over the muscular ridge thence rearward of said trough to and becoming the inside edge area of said thumb/handle spacer, said rear perimeter aiding in stabilizing and causing forward skin displacement due to said gripping motion and said external pressure of said glove, said web pocket anchor being integral with portions of said thumb/handle spacer, said rear perimeter and said outer web cushion, said web pocket anchor flexing and arcing interiorly contouring the hand's web pocket adjacent the thumb second joint within the upper web, said web pocket anchor aiding in relocating and compacting the upper web into a lower position aiding in creating a flesh roll insulating the thumb second joint and bracing said hand grip in receiving said inertial handle force in a lower area of the upper hand than without said web pocket anchor, said arcing interiorly of said web pocket anchor allowing said outer web cushion to anchor within said upper hand plane in a lower area than without said web pocket anchor (and said trough) stabilizing said outer web cushion against upward force of said inertial handle.

4. The hand grip as defined in claim 3 wherein:

an outer wall of said trough extending outwardly and exteriorly to and integrally with said outer web cushion, interiorly, an outer portion of said outer web cushion anchoring atop the hand's index knuckle being a knuckle mount, said knuckle mount in conjunction with said trough aiding in bracing an inner portion of said outer web cushion externally of an inner area of the index knuckle and outer area of the upper web, said inner portion being an index cushion, an index knuckle ridge being above/exterior of said index cushion, said index cushion overlapping an outer portion of the hand's upper web, said index knuckle ridge being integral with a forward portion of said trough, said index cushion aiding a forward portion of said trough to be braced in a forward extension externally of the upper web, said index knuckle ridge being a thickened area, said index knuckle ridge aiding in bracing said forward extension, said forward extension and said overlapping locating a forward portion of said outer web cushion arcing externally of the hand's web band and index finger tendon increasing the cushioning strength of said upper hand plane against said inertial handle force, said external pressure bracing said upper hand plane also aiding in preventing said outer web cushion from buckling rearward from recoiling handle force, thus said outer web cushion acting as a cushion dispersing said inertial handle force away from sensitive knuckles and tendons, said handle not moving directly into contact with said trough, said handle braced and cushioned externally of said trough by said outer web cushion, said outer web cushion bending and carrying said handle across said trough to said handle lever of said thumb/handle spacer and to said thumb joint anchor, said thumb joint anchor when closing approaching a right angle to the face of said outer web cushion when contacting said handle such that a shearing type contact is made greatly reducing stress to the upper hand.

5. The hand grip as defined in claim 4 wherein:

a trough recess located interiorly (hand side) of said trough, said trough recess actually being a recess within said web pocket anchor, said web pocket anchor extending rearward and forward from said trough recess, said trough recess aiding in enabling said external pressure above said web pocket anchor pressing said web pocket anchor interiorly to lift a forward portion of said trough, said trough arcing lengthwise (front to back) due to a tilt, said tilt being an angle within said upper hand plane crosswise to said trough, an apex of said angle being said trough recess, said angle (said tilt) tilting forward and rearward portions of said mid hand plane downwardly, an inner, rear portion of said thumb/handle spacer having a ridge extending rearwardly partially parallel and angling towards said trough, said ridge being a thumb ridge, said thumb ridge having a thumb apex above and outward of the thumb knuckle, said thumb apex being integral with an upper portion of said inner wall of said trough, a trough bridge extending between said thumb apex of said thumb ridge across said trough to a knuckle apex of said index knuckle ridge, said knuckle apex being above and inward of the index finger knuckle, said trough bridge being the exterior side of said trough recess, said trough bridge being within said channel of said trough but a less internal portion of said trough, said trough bridge, said thumb apex and said knuckle apex being at the apex of said tilt (said arcing lengthwise), said trough recess allowed by said trough bridge and said tilt, said external pressure from said glove applying downward pressure at said thumb apex of said thumb ridge and at said knuckle apex of index knuckle ridge forcing said web pocket anchor and portions of said upper hand plane rearward of said trough bridge to move interiorly, a combination of said tilt and said trough recess allowing said move interiorly creating an extension in a forward area of said trough, said extension aiding in bracing a forward portion of said upper hand plane externally of sensitive knuckle portions surrounding and integral with the upper web, a forward portion of said trough allowing the hand's index knuckle to "roll" inwardly increasing support of said outer web cushion against said inertial handle force, a forward portion of said trough recess also providing space for an upper portion of the hand's relocated, compacted upper web preventing pressure building up at an area of the index finger knuckle and tendon, a forward edge of said trough connecting with said outer web cushion at a pivot, said pivot being internal of an external area of said outer web cushion, said external area of said outer web cushion and a portion of said handle lever receiving said inertial handle force preserving the integrity of said pivot and said trough, said pivot in conjunction with said trough facilitating the described desired gripping motion.

6. The hand grip as defined in claim 5 wherein:

said outer/mid connection of said outer transverse anchor located adjacent and inward of said offset connection, an interior side of said outer/mid connection extending downwardly as a lifeline anchor, during said internal bending adjacent and outward of said offset connection said lifeline anchor pressing into the hand's lifeline trough stabilizing said hand grip, an exterior side of said outer/mid connection being a portion of said handle contact area, downwardly of said exterior side being an exterior side of said lifeline anchor, said exterior side of said lifeline anchor being a handle contact ridge, said handle contact ridge arcing externally during said gripping motion, said internal bending arcing internally primarily widthwise, said internal bending being a channel, said channel being adjacent and outward of said handle contact ridge, said channel having direct handle contact in bottom hand gripping.

7. The hand grip as defined in claim 4 wherein:

said outer/mid connection of said outer transverse anchor located outward of said offset connection adjacent a primary handle contact, said primary handle contact being an outer portion of said mid hand cushion, said outer transverse anchor having an outer edge pressing adjacent the hand's outer transverse crease and an inner edge being a bridging edge, before gripping the majority of said outer transverse anchor angled and held externally of the palm connecting externally of the palm with said mid hand cushion adjacent said primary handle contact adjacent the hand's lower transverse crease, a portion of said primary handle contact integrally extending inwardly as a ring finger trough anchor within said mid hand cushion, said ring finger trough anchor extending inwardly/downwardly extending to said lower lifeline anchor, said lower lifeline anchor being a portion of an inner end of said mid hand cushion and a lower end of said inner hand structure, a curving (or arcing) of said ring finger trough anchor increasing during gripping moving said handle contact area lower and more externally, said curving causing said mid hand cushion to have an external arc aiding in strengthening said handle contact area, said outer edge of said outer transverse anchor anchoring against the hand under pressure of said handle, said outer edge extending from the upper end of the hand's outer transverse crease downwardly becoming integral with said mid hand perimeter at the hand's lower transverse crease, said mid hand perimeter pressing against the hand (anchoring) roughly parallel and below said ring finger trough anchor to said lower lifeline anchor, a portion of said outer edge integral with said mid hand perimeter being a shift line arc, said shift line arc resting on and partially supported by the hand's shift line support, said shift line arc being an outer most portion of said mid hand cushion, a portion of said internal bending being a channel, said channel within said mid hand cushion being outward and below said offset connection, said channel allowing an enhancement of said external arc.

8. The hand grip as defined in claim 7 wherein:

the interior side of said inner hand structure being an interior plane, said interior plane facing upwardly such that lower portions of said interior plane press against the lower thumb base and lower lifeline, said inner hand structure consisting of said deflector integral with a thumb harness, the location of said offset connection paralleling the lifeline trough, the upper portion of said offset connection being exterior of the lifeline trough before said inertial handle force being phase one of said gripping motion, said thumb harness extending integrally upward from said lower lifeline anchor and inwardly from the area of said offset connection adjacent said ring finger trough anchor, said deflector extending upwardly and externally from said thumb harness and inwardly from said offset connection, said thumb harness contacting the hand's thumb base, said thumb harness becoming external of the thumb base at said integral connection with said deflector, said deflector extending further externally of the thumb and palm, said deflector spaced a distance below the thumb first and second joints not touching the hand during said phase one, said deflector being angled roughly perpendicular to said handle creating forward and external leverage bracing said primary handle contact and adjoining handle contact area against said inertial handle with an outer portion of said thumb base lever being a portion of said handle contact area.

9. The hand grip as defined in claim 8 wherein:

said shift line arc bracing a lower portion of said bridging edge (said inner edge) of said outer transverse anchor externally of the palm, said lower portion of said bridging edge being external of the palm aiding said handle contact area in maintaining said handle exterior and outward of the palm, said handle pressing said outer edge of said outer transverse anchor against the hand serving to anchor said outer transverse anchor, said outer transverse anchor due to said pressing aiding in stabilizing said upper, said inner, and said mid hand structures in their proper positions, an outer portion of said bridging perimeter, outward of said thumb base lever connecting to said primary handle contact at a junction, said junction also being the connecting area of said bridging edge of said outer transverse anchor, an outer/upper portion of said primary handle contact being integral with and a lowest portion of said outer transverse anchor, the majority of said thumb base lever located and braced externally of the hand's palm during gripping, a recess existing internally of said primary handle contact, a portion of said recess held externally of the hand throughout the grip by surrounding structure, said surrounding structure being a lifeline anchor, said lower lifeline anchor, said thumb harness, said deflector, said ring finger trough anchor, said mid hand perimeter, said bridging perimeter, said shift line arc and said outer transverse anchor (pressed by said handle), said recess bridging over and protecting the middle, ring and little finger tendons and providing a cushion under said handle contact area said recess aiding in providing a forward flexing, said forward flexing allowing the inner hand to move said inner hand structure further forwardly and downwardly bracing said exterior arc of said mid hand cushion against said inertial handle force, said forward flexing allowing said exterior arc of said mid hand cushion to increase during gripping creating further contact with said handle extending the length of said handle contact area effectively widening the gripping area of the hand thus improving control of said handle.

10. The hand grip as defined in claim 9 wherein:

said offset connection between said mid hand cushion and said inner hand structure aiding in producing an internal ridge, said internal ridge being said lifeline anchor, said lifeline anchor created partially as a result of said bending and partially as a result of said inner hand structure positioned interiorly of (closer to the hand than) said mid hand cushion along said offset connection, said inner hand structure aiding in bracing said mid hand cushion externally of sensitive finger tendons maintaining said recess against said inertial handle force, said forward flexing of said mid hand cushion allowing the inner hand to move fully downward/forward with no constriction of the gripping motion, said lifeline anchor created in part by said internal bending, during gripping under pressure of said handle an upper end of said lifeline anchor extending further internally and having a crescent shaped arc, said crescent shaped arc being a lower portion of said bridging edge, said crescent shaped arc being a thumb spread, said lifeline anchor aiding in reinforcing said inner hand structure leveraging and bracing against said inertial handle force, said lifeline anchor extending downward toward said lower lifeline anchor, said lifeline anchor being exterior of the hand's lifeline during phase one (relaxed) grip, during said gripping motion said internal bending outward and adjacent said offset connection causing said lifeline anchor to turn inwardly while moving internally due to the angle of said offset connection, said turning inwardly avoiding the sensitive middle and index finger tendons, said turning inwardly moving said lifeline anchor in a hooking approach toward the hand's lifeline trough during said griping motion, said lifeline anchor pressing snugly into the hand's lifeline trough while avoiding surrounding sensitive portions of the hand, said lifeline anchor aiding in bracing said handle contact area and adjacent structure externally of sensitive tendons and bones against said inertial handle force, said upper end of said lifeline anchor delineated as said thumb spread pressing internally within the hand's lower web wedging between the thumb bone and index finger tendon creating a spreading without impeding downward, outward movement of the thumb at the third joint and entire inner hand, said thumb spread relocating the fleshy lower web upwardly and inwardly further compacting the hand's flesh roll under (internal of) said deflector and above (external of) the thumb second joint, the flesh roll padding and insulating the thumb second joint and partially aiding in bracing said deflector above the thumb second joint.

11. The hand grip as defined in claim 10 wherein:

said planer said inner hand structure extending in a lengthwise direction from said lower lifeline anchor to an upper exterior edge of said deflector adjacent an exterior edge of said thumb joint anchor at said spaced connection, said lengthwise direction being basically in line with the hand's extending thumb when not bent, said thumb joint anchor having a roughly ninety degree angle of attachment at said spaced connection to said interior planer side of said deflector at a line of attachment from said exterior edge of said thumb joint anchor to an interior edge of said thumb joint anchor, said line of attachment being roughly in the direction of said lengthwise direction, said angle of connection and said line of attachment allowing a widthwise swiveling of said deflector as the desired downward/forward motion of the thumb flush with said thumb joint anchor causes said deflector to pivot such that an upper/inner edge of said deflector moves upwardly to rest between the thumb second joint and thumb first joint, and an outer portion of said deflector with said thumb base lever moves downwardly to a stronger position bracing said primary handle contact and outer transverse anchor against said inertial handle force from a lower and more exterior position than without said widthwise swiveling.

12. The hand grip as defined in claim 6 wherein:

said thumb joint anchor attaching upwardly to said thumb/handle spacer at an upper spaced connection, said upper spaced connection being in an upper line of attachment, said upper line of attachment producing a widthwise swiveling of said thumb/handle spacer similar to said widthwise swiveling of said deflector such that said thumb/handle spacer pivots with said handle lever dipping downwardly contacting said handle at a lower position than without said swiveling creating added cushioning power of said handle lever and bracing said thumb/handle spacer outwardly of a sensitive inner portion of the thumb knuckle.

13. The hand grip as defined in claim 1 wherein:

said offset connection being a base of an external ridge extending (protruding) externally, said external ridge being a handle contact ridge, said handle contact ridge extending downwardly, a portion of said handle contact ridge being a portion of said handle contact area, said handle contact ridge reinforcing said mid hand cushion preventing collapse against said inertial handle force.

14. The hand grip as defined in claim 1 wherein:

said hand grip is used in conjunction with lower hand grip fulcrum platform of hand accessory 500, said hand grip and said lower hand grip mounted spaced apart, or attached, said attachment being at said mid hand perimeter of said hand grip and said fulcrum platform of said lower hand grip.

15. In combination with a handle of an implement when said handle is to be manually swung in motion or lifted by a bare or gloved gripping hand of a human, initial forward movement of said handle by the hand creating an inertial handle force against the hand, the outer hand being the knuckles and fingers bordered inwardly by a transverse crease, the inner hand being inward of the transverse crease, a ring finger hollow located at an intersection of a lower transverse crease and an outer branching transverse crease, the two creases together being a shift line, outwardly of the shift line a fleshy area of the hand being a shift line support adjacent the ring finger hollow, the hand having a gripping motion when swinging a baseball bat wherein the inner hand moves outwardly (forwardly) and downwardly and/or upwardly in relation to the shift line and said handle, a hand grip constructed to conform with the hand and said gripping motion of said hand, a handle contact area within said hand grip making direct contact with said handle, portions of said handle contact area receiving varying degrees of said inertial handle force, said hand grip having a plurality of anchors, said anchors resting or pressing against tough or fleshy areas of the hand, some of said anchors being a portion of said handle contact area; said hand grip consisting of two semi-horizontal/semi-planer structures, planer portions of said two semi-horizontal/semi-planer structures having a roughly parallel alignment with each other, said two semi-horizontal/semi-planer structures being an upper hand plane and a mid hand plane, said upper hand plane having an interior side resting atop the upper hand facing downwardly, said mid hand plane having an interior side with an upper portion being partially external and facing partially upwardly, said mid hand plane having a lower perimeter portion of said interior side being an anchoring perimeter pressing against the hand, a majority of said mid hand plane having roughly the shape of an inverted pyramid, said shape being an inverted triangle portion, the inner hand/thumb base and mid hand/tough ball of the gripping hand providing a roughly ninety degree V-shaped foundation for said anchoring perimeter, said anchoring perimeter being the area of two legs of said inverted triangle portion of said mid hand plane, one of said two legs being a thumb harness perimeter, said thumb harness perimeter anchoring against an inner portion of the hand's thumb base, the second of said two legs being a mid hand perimeter, said mid hand perimeter anchoring against the hand's lower palm/tough ball area, said mid hand perimeter extending from an area of the hand's tough ball adjacent the lower transverse crease inwardly to the hand's lower lifeline, said mid hand perimeter being a lower portion of a mid hand cushion, an apex of said inverted triangle portion (lowest portion) being a lower lifeline anchor anchoring in the hand's lower lifeline, said mid hand perimeter and said thumb harness perimeter having an integral joining at said lower lifeline anchor, said thumb harness perimeter resting against the thumb base between said lower lifeline anchor and the thumb, said thumb harness perimeter extending upwardly, outwardly and externally/horizontally towards a bridging perimeter, the position of said outwardly and externally/horizontally depending on the position of the thumb during gripping, said two legs being said anchoring perimeter, a third side of said inverted triangle portion of said mid hand plane being a bridging perimeter, said bridging perimeter being a portion of said upper said partially external side, with the hand in phase one position (prior to said inertial handle force) said bridging perimeter extending over (externally of) the palm between an upper portion of said thumb harness perimeter and an upper portion of said mid hand perimeter such that said inverted triangle portion being a relatively planer surface (prior to gripping) and aided by said anchoring perimeter having tension strengthening outer portions of said bridging perimeter leveraging into contact against said handle, an internal bending within said mid hand plane occurring during gripping creating a channel, said channel extending from adjacent said bridging perimeter downwardly to an upper portion of said mid hand perimeter (seen externally), a portion of said channel (said internal bending) anchoring against the hand in conjunction with said mid hand perimeter and said lower lifeline anchor supporting said handle contact area and being a cushion for said handle, said channel (said internal bending) partially contributing to the creation of an internal ridge, said channel being outward of said internal ridge, said channel integrally joined with said internal ridge at an offset connection, an upper portion of said internal ridge being a lifeline anchor, said lifeline anchor pressing within the hand's lifeline trough during gripping, said offset connection delineating two main portions of said mid hand plane, said mid hand cushion being outward of said offset connection and an inner hand structure being inward of said offset connection, said lifeline anchor strengthening said inner hand structure, said lifeline anchor and said inner hand structure serving to brace and leverage said handle contact area outwardly against said inertial handle force; said upper hand plane having a rear perimeter extending from atop the index knuckle rearwardly over the muscular ridge thence extending forwardly to the area of the thumb first joint, said rear perimeter partially encircling a trough, said trough seen at an exterior side of said upper hand plane, said trough being a channel arcing internally above the upper web, said rear perimeter being an anchoring perimeter, an upper hand bridging perimeter located at a remaining perimeter area of said upper hand plane primarily forwardly of said rear perimeter, with the hand in said phase one position said upper hand bridging perimeter extending between said rear perimeter adjacent the thumb first joint and said rear perimeter adjacent the index knuckle, said location of said upper hand bridging perimeter being external of portions of the hand, portions of said upper hand bridging perimeter being forward of the web, said external and said forward locations creating a cushion in the upper hand against said inertial handle force, a portion of said handle contact area extending from said mid hand cushion of said mid hand plane to said upper hand bridging perimeter of said upper hand plane, portions of said semi-horizontal/semi-planer structures being roughly perpendicular to said handle both bracing said handle contact area and being portions of said handle contact area cushioning the hand against said inertial handle force.

16. The hand grip as defined in claim 15 wherein:

two vertical band-like structures connecting with said mid hand plane and said upper hand plane, said connecting being roughly perpendicular when said hand grip is unmounted, said two vertical band-like structures being a thumb joint anchor and an outer transverse anchor, said thumb joint anchor extending from an inner portion of said bridging perimeter at said inner hand structure of said mid hand plane upwardly to an inner portion of said upper hand bridging perimeter, said inner portion of said upper hand bridging perimeter being a handle lever, said outer transverse anchor extending from an outer/mid connection with said bridging perimeter of said mid hand plane upwardly to an outer portion of said upper hand bridging perimeter, said outer portion being an outer web cushion.

17. The hand grip as defined in claim 16 wherein:

said outer/mid connection of said outer transverse anchor located adjacent and upward of said channel, an interior side of said outer/mid connection extending downwardly as said lifeline anchor, during said internal bending said lifeline anchor pressing into the hand's lifeline trough stabilizing said hand grip, an exterior side of said outer/mid connection and said lifeline anchor arcing externally being a handle contact ridge, said handle contact ridge arcing during gripping contributing to an exterior arc within said mid hand cushion, said handle contact ridge both bracing and being a portion of said handle contact area and being leveraged and braced downwardly by said inner hand structure against upward said inertial handle force.

18. The hand grip as defined in claim 16 wherein:

said outer/mid connection of said outer transverse anchor located primarily outward of said offset connection at an outer portion of said bridging perimeter, said outer transverse anchor having an outer edge, a lower end of said outer edge integrally joined with an upper end of said mid hand perimeter outward of the hand's lower transverse crease, an area of said integrally joined said outer edge and said mid hand perimeter being a shift line arc, said shift line arc anchoring on the hand's shift line support, said shift line arc being an outer edge portion of a primary handle contact within said mid hand cushion, said primary handle contact being integral with an upper portion of said mid hand cushion and a lower end of said outer transverse anchor, said areas being outer portions of said bridging perimeter, said outer transverse anchor and integrally joined said outer web cushion having a common inner edge being a bridging edge, a widening of said outer web cushion and said outer transverse anchor causing a second outer/mid connection area to be located at a further inward portion of said bridging perimeter.

19. The hand grip as defined in claim 18 wherein:

within said mid hand plane, an inner portion of said bridging perimeter being an outer external edge of a deflector, said deflector being an upper and most external portion of said inner hand structure, an outer/external edge portion of said deflector facing outwardly/externally toward said handle and being roughly perpendicular to said handle during said gripping motion, said outer/external edge of said deflector (said inner portion of said bridging perimeter) being a thumb base lever, an outer portion of said bridging perimeter, outward of said thumb base lever attaching to said second outer/mid connection and being a portion of said handle contact area, said second outer/mid connection being an upper end of said channel, interior and below said second outer/mid connection a recess providing clearance for sensitive finger tendons, said recess maintained by integrally joined said mid hand perimeter and said outer edge of said outer transverse anchor (said shift line arc) anchoring outwardly of said recess, and by said lifeline anchor inwardly of said recess, and by said anchoring perimeter.

20. The hand grip as defined in claim 19 wherein:

within said upper hand plane, said upper hand bridging perimeter being integral with a forward portion of said outer web cushion, a forward portion of said trough, and said handle lever, said outer web cushion integral with said trough and said rear perimeter, said outer web cushion extending externally/forwardly then downwardly integrally joining said outer transverse anchor, an outer edge portion of said outer web cushion contouring and pressing against the hand's index knuckle and finger, said handle lever extending between the inner most portion of said upper hand bridging perimeter to and being integral with the forward most portion of said trough, said thumb joint anchor extending from said handle lever adjacent the thumb first joint downwardly contouring the thumb (web side) to a spaced connection at the interior planer side of said deflector, said spaced connection aiding in bracing said deflector and bracing said mid hand plane below and external of the thumb knuckle and portions of the thumb base, said spaced connection aiding in maintaining upper/outer portions of said mid hand plane external of the hand and both said mid and upper hand planes perpendicular to said handle, said anchoring perimeter of said mid hand plane providing foundational support against upward said inertial handle force, said two semi-horizontal/semi-planer structures providing truss-like support against inward and internal said inertial handle force, said vertical band-like structures providing suspension-type support against downward handle force.

21. The hand grip as defined in claim 20 wherein:

within said mid hand plane, said offset connection partially creating said internal ridge partially causing a lower portion of said inner hand structure adjacent and below said bridging perimeter to have an interior location (closer to the hand) relative to said mid hand cushion such that said inner hand structure braced by portions of the hand's lower thumb base, lower lifeline and lifeline trough aids in supporting a portion of said mid hand cushion externally of the hand, said upper portion of said internal ridge being said lifeline anchor, an upper end of said lifeline anchor extending further internally relative to the lower end, said upper end being a thumb spread, the combination of said thumb base lever, said thumb spread, said lifeline anchor, said recess and said primary handle contact supplying a cushioning force and a leveraging force against said inertial handle, a recessed area between said thumb spread and said lower lifeline anchor, said recessed area along with said recess and said channel allowing forward flexing of lower portions of said mid hand plane during phase two gripping, said forward flexing further enhancing outward/external motion of said deflector increasing the leveraging force of said inner hand structure in strengthening said mid hand cushion.

22. The hand grip as defined in claim 21 wherein:

said deflector being angled at said bridging perimeter forwardly/externally such that said deflector having a planer protrusion, said mid hand plane anchoring in the hand's tough ball/mid palm and lowest, strongest portions of the thumb base, the anchoring area at the thumb base being a thumb harness, said thumb harness extending downwardly from said deflector to and being integral with said thumb harness perimeter and said lower lifeline anchor, the anchoring area at the tough ball/mid palm being a ring finger trough anchor, said ring finger trough anchor extending inwardly and below said primary handle contact integral with said channel upwardly of said mid hand perimeter to said lower lifeline anchor, said recessed area below said thumb spread in conjunction with said channel forwardly of said lifeline anchor, said lower lifeline anchor and said thumb harness perimeter creating a planer recess, said planer recess flexing forwardly increasing said forward flexing providing space for the bulging thumb base at a weaker portion of the thumb base, said lower lifeline anchor located adjacent the hand's sensitive bony heel pressing against the hand's lower (bony but tough) lifeline, said lower lifeline anchor bracing said mid hand perimeter integral with said ring finger trough anchor in protection of the bony heel (hamate) and little and ring finger tendons, said planer recess causing relative increased interior extension of surrounding anchoring structure increasing the amount of said inertial handle force being dispersed to said lifeline anchor, said lower lifeline anchor, said thumb harness and said thumb harness perimeter, reducing stress to the thumb and upper hand and strengthening said handle contact area.

23. The hand grip as defined in claim 22 wherein:

a separation between said bridging perimeter and said bridging edge of said outer transverse anchor at said second outer/mid connection causing a lower portion of said bridging edge to be said thumb spread, said thumb spread moving internally against the lower web during said gripping motion allowing said lifeline anchor and said inner hand structure greater power and flexibility moving forwardly.

24. In combination with a handle of an implement when said handle is to be manually swung in motion or lifted by a bare or gloved gripping hand of a human, initial forward movement of said handle by the hand creating an inertial handle force against the hand, the outer hand being the knuckles and fingers bordered inwardly by a transverse crease, the inner hand being inward of the transverse crease, a ring finger hollow located at an intersection of a lower transverse crease and an outer branching transverse crease, the two creases together being a shift line, outwardly of the shift line a fleshy area of the hand being a shift line support adjacent the ring finger hollow, the hand having a gripping motion when swinging a baseball bat wherein the inner hand moves outwardly (forwardly) and downwardly and/or upwardly in relation to the shift line and said handle, a hand grip constructed to conform with the hand and said gripping motion of the hand in the gripping of a primarily straight, rounded handle during said counteracting of said inertial handle force, a handle contact area within said hand grip making direct contact with said handle, portions of said handle contact area receiving varying degrees of said inertial handle force, said hand grip having a plurality of anchors, said anchors resting or pressing (anchoring) against tough or fleshy areas of the hand, said anchoring being enhanced by external pressure from any outer covering of said hand grip such as a glove or portion of a glove, said anchoring also being enhanced by pressure from said gripping motion and/or pressure from said handle, some said anchors aided by said external pressure relocating and compacting fleshy areas of the hand known as fleshy relocation, said fleshy relocation providing protection for the hand and support for said hand grip, some of said anchors being a portion of said handle contact area, some of said anchors acting to support and brace said handle contact area; said hand grip being composed of a horizontal/semi-planer structure, said horizontal/semi-planer structure being an upper hand plane, said upper hand plane resting atop the upper hand such that an interior side of said upper hand plane facing downwardly, an exterior side (top) of said upper hand plane having a trough, said trough being a channel extending front to rear above the hand's upper web between the index knuckle and thumb knuckle, said upper hand plane having a perimeter area, said perimeter area composed of a rear perimeter and an upper hand bridging perimeter, said rear perimeter extending from adjacent the thumb first joint rearward and outwardly rearward of said trough, said rear perimeter thence extending over the muscular ridge and forwardly to adjacent the index finger knuckle, said rear perimeter anchoring said upper hand plane under said external pressure of said outer covering such as said glove or portion of said glove, said upper hand bridging perimeter completing said perimeter area forwardly of said rear perimeter, said upper hand bridging perimeter integral with said rear perimeter at an area adjacent the hand's thumb first joint, said upper hand bridging perimeter extending externally of the hand above the hand's web apex to an integral connection with said rear perimeter at an area adjacent the hand's index finger knuckle, said upper hand bridging perimeter braced said externally of the hand by said anchoring of said rear perimeter, by said trough and by other reinforcing and bracing structure, said upper hand bridging perimeter cushioning against said inertial handle force, an outer portion of said upper hand bridging perimeter adjacent the index finger knuckle being an outer web cushion, an inner portion of said upper hand bridging perimeter adjacent the thumb first joint being a handle lever, a forward portion of said trough being integral with an inner portion of said outer web cushion and an outer portion of said handle lever, a portion of said outer web cushion extending forwardly and downwardly of the index knuckle increasing said cushioning of said upper hand bridging perimeter, during griping and under said external pressure said trough flexing and dipping internally within the hand's upper web allowing said handle lever to move outwardly and downwardly strengthening said upper hand bridging perimeter and bracing said handle, interiorly (hand side), a rear portion of said trough being a web pocket anchor, said web pocket anchor pressing within the hand's web pocket relocating the upper web downwardly in support of forward portions of said upper hand plane bracing said external position of said upper hand bridging perimeter against said inertial handle force.

25. The hand grip as defined in claim 24 wherein:

seen exteriorly, a portion of said rear perimeter adjacent the thumb bending above the thumb knuckle during gripping, said portion being a thumb ridge, seen exteriorly, an inner portion of said outer web cushion arcing above the index knuckle, said inner portion being an index knuckle ridge, said index knuckle ridge being integral with an outer wall of said trough, said thumb ridge being integral with an inner wall of said trough, a thickened portion being a most rearward portion of said rear perimeter, said thickened portion located rearward of said trough, said thickened portion also being a most rearward portion of said web pocket anchor, said thickened portion being under said external pressure aiding in enhancing said fleshy relocation and said bracing of said upper hand plane against said inertial handle force, said upper hand plane having two band-like connecting structures, said two band-like connecting structures being a thumb joint anchor and an outer transverse anchor, an upper end of said thumb joint anchor connecting and being integral with said handle lever, said thumb joint anchor extending downwardly pressing against the outside of the thumb (web side) and extending underneath the thumb, said thumb joint anchor having a means of attachment to a glove, said thumb joint anchor serving to create leverage at said handle lever bracing said upper hand bridging perimeter against said inertial handle force, an upper end of said outer transverse anchor being integrally connected with a forward portion of said outer web cushion, said outer transverse anchor extending from said outer web cushion downwardly adjacent the hand's transverse crease, said outer transverse anchor having a means of attachment to said external glove, said outer transverse anchor being a portion of said handle contact area serving to dissipate said inertial handle force, said handle pressing an outer edge portion of said outer transverse anchor against said hand serving to anchor and stabilize said hand grip.

26. The hand grip as defined in claim 25 wherein:

a lower end of said thumb joint anchor having a connection with a bridging perimeter of a mid hand plane, said thumb joint anchor aiding in spacing said mid hand plane below the thumb and externally of the hand, said mid hand plane being partially horizontal and semi-planer such that an upper edge portion of said mid hand plane being external and facing outwardly toward said handle, said upper edge portion being said bridging perimeter, an inner portion of said bridging perimeter during gripping being roughly perpendicular to said handle, said inner portion being a thumb base lever, said connection of said thumb joint anchor located adjacent said thumb base lever, a lower edge portion of said mid hand plane being an anchoring perimeter, said anchoring perimeter anchoring against the hand and being located below and internally of said bridging perimeter, said anchoring perimeter composed of a thumb harness perimeter extending from the hand's lower lifeline upwardly adjacent the hand's thumb base, and a mid hand perimeter extending outwardly from the hand's lower lifeline to the area of the tough ball, said mid hand plane having an internal bending during said gripping motion, said internal bending being a channel, said channel (said internal bending) aiding in creating an internal ridge pressing into the hand's lifeline trough, said internal ridge being a lifeline anchor, a lower end of said outer transverse anchor having an outer/mid connection with a portion of said bridging perimeter of said mid hand plane, said outer/mid connection strengthening said outer transverse anchor and said upper hand bridging perimeter against said inertial handle force.

27. The hand grip as defined in claim 26 wherein:

said outer/mid connection of said outer transverse anchor located adjacent and inward of said channel, said outer/mid connection being integral with an upper portion of said lifeline anchor, an interior side of said outer/mid connection extending downwardly integral with said lifeline anchor increasing the depth of said lifeline anchor, an exterior side of said outer/mid connection being a portion of said handle contact area, downwardly of said exterior side being an exterior side of said lifeline anchor, said exterior side of said lifeline anchor being a handle contact ridge, said handle contact ridge extending externally, primarily lengthwise during said gripping motion, said channel (said internal bending) arcing internally, primarily widthwise, said channel being adjacent said handle contact ridge, said channel having direct handle contact in bottom hand gripping.

28. The hand grip as defined in claim 26 wherein:

an outer portion of said outer/mid connection of said outer transverse anchor located outward of said lifeline anchor adjacent a primary handle contact at an outer portion of said bridging perimeter, said primary handle contact being adjacent the hand's lower transverse crease, said primary handle contact being outward of said channel, said outer transverse anchor having said outer edge pressing adjacent and outward of the hand's outer transverse crease and an inner edge being a bridging edge, said bridging edge connecting externally of the palm at an outer portion of said bridging perimeter, below said primary handle contact an outer and lower portion of said mid hand plane having an external arc, said portion having said external arc being integral with said mid hand perimeter and said primary handle contact, said channel being integral and upward of said external arc and inward of said primary handle contact, said bending interiorly of said channel enhancing a bending exteriorly and downwardly of said external arc, said channel arcing internally serving to anchor said handle contact area, said anchoring perimeter pressing against the hand under said external pressure of said glove, said external pressure aiding in preventing said anchoring perimeter from spreading under said inertial handle force aiding in maintaining said external arc, said mid hand cushion aided by said external arc absorbing and dispersing said inertial handle force to said anchoring perimeter, said external arc having spring-like cushion preventing collapse of said mid hand plane protecting sensitive finger tendons within the hand.

29. The hand grip as defined in claim 28 wherein:

said outer transverse anchor having an inward branch branching inwardly, said inward branch creating a second lower end of said outer transverse anchor having a second outer/mid connection with said bridging perimeter of said mid hand plane, said second outer/mid connection located adjacent said lifeline anchor, said inward branch being a lifeline anchor extension, said lifeline anchor extension pressing within the hand's lifeline trough at an area upwardly and outwardly of the anchoring area of said lifeline anchor, said lifeline anchor extension further dissipating said inertial handle force into said lower and tougher receiving areas of the hand, a space created between said outer transverse anchor and said inward branch (said lifeline anchor extension), said space being an anchor space.

30. The hand grip as defined in claim 28 wherein:

said outer transverse anchor having an inward branch branching inwardly, said inward branch extending inwardly from said outer transverse anchor adjacent the area of the hand's ring finger trough, said inward branch connecting with said bridging perimeter at said second outer/mid connection, a widening of said outer transverse anchor causing said second outer/mid connection to be a lowest portion of said bridging edge, said lowest portion of said bridging edge connecting with an inner portion of said bridging perimeter, an outer/lower portion of said inward branch connecting with an outer portion of said bridging perimeter, a lower internal portion of said inward branch pressing within said ring finger trough, an exterior portion of said inward branch being a handle contact ridge, said inward branch enclosing a space between said primary handle contact and said mid hand perimeter, said space being an anchor space, said anchor space occupying a portion of said channel, said anchor space providing flexibility, said anchor space allowing said handle contact ridge within said bridging perimeter to move further outwardly and exteriorly during gripping increasing support of said handle at a lower area of the hand than without said anchor space.

31. The hand grip as defined in claim 30 wherein:

a thumb/handle spacer located between said handle lever and a portion of said rear perimeter, said portion being an area extending between said thumb joint anchor and an integral connection of said rear perimeter with an inner wall of said trough, said thumb/handle spacer extending between said handle lever and said rear perimeter from said thumb joint anchor to said trough and having a trough connection, with said hand grip un-mounted (the hand not gripping), said trough connection causing said thumb/handle spacer to be at roughly a right angle to said trough, an interior portion of said thumb/handle spacer at said trough connection connecting with said web pocket anchor, interiorly, said web pocket anchor extending rearward from a deepest protruding area at roughly a rear portion of said trough connection, said web pocket anchor extending to a thickened, integral most rearward portion of said rear perimeter, said index knuckle ridge extending from said outer web cushion to said most rearward portion of said rear perimeter, said most rearward portion of said rear perimeter extending upwardly of the hand when not under said external pressure of said glove, when under said external pressure, said glove pressing said rear perimeter downwardly firmly anchoring said web pocket anchor within the upper web, said extending upwardly causing said web pocket anchor to act as a fulcrum as in a teeter totter with said external pressure of said glove at said rear perimeter creating a lift at a forward end of said index knuckle ridge supporting said upper hand bridging perimeter against said inertial handle force.

* * * * *